US008075353B2

(12) United States Patent
Suzuki et al.

(10) Patent No.: US 8,075,353 B2
(45) **Date of Patent: *Dec. 13, 2011**

(54) BOAT PROPULSION UNIT

(75) Inventors: Takayoshi Suzuki, Shizuoka (JP); Mitsuhiro Ryuman, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 296 days.

This patent is subject to a terminal disclaimer.

(21) Appl. No.: 12/413,669

(22) Filed: Mar. 30, 2009

(65) Prior Publication Data

US 2009/0247026 A1 Oct. 1, 2009

(30) Foreign Application Priority Data

Mar. 31, 2008 (JP) ..... 2008-090884

(51) Int. Cl.
*B63H 21/22* (2006.01)
*B63H 23/00* (2006.01)

(52) U.S. Cl. ..... 440/1

(58) Field of Classification Search ..... 440/1, 2, 440/75, 84, 86, 87

See application file for complete search history.

(56) References Cited

U.S. PATENT DOCUMENTS 4,843,368 A * 6/1989 Poulos ..... 340/464
4,898,563 A * 2/1990 Torigai et al. ..... 440/1
4,976,636 A * 12/1990 Torigai et al. ..... 440/1

FOREIGN PATENT DOCUMENTS

JP 3499204 B2 2/2004

* cited by examiner

*Primary Examiner* — Daniel Venne
(74) *Attorney, Agent, or Firm* — Keating & Bennett, LLP

(57) ABSTRACT

A boat propulsion unit includes a power source, a propeller, a shift position changing mechanism, a control device, and a speed reducing switch. The shift position changing mechanism has an input shaft, an output shaft, and first and second clutches. The first and second clutches change the connection state between the input shaft and the output shaft. In the shift position changing mechanism, the first and second clutches are engaged or disengaged, thereby changing the shift position among forward, neutral, and reverse. The control device controls connecting forces of the first and second clutches so that the propeller generates propulsive forces in the direction opposite to the present propulsive direction of a hull when the speed reducing switch is turned on by the operator of the boat. The boat propulsion unit easily retains the propulsive speed of a hull substantially at zero.

17 Claims, 16 Drawing Sheets

| Member name (reference numeral) | ○ : clutch engaged state × :clutch disengaged state | | | | |
|---|---|---|---|---|---|
| Gear ratio changing hydraulic clutch (53) | × | ○ | × (○) | × | ○ |
| First shift changing hydraulic clutch (61) | × | × | × | ○ | ○ |
| Second shift changing hydraulic clutch (62) | ○ | ○ | × | × | × |
| One-way clutch (58) | Prevent reverse rotation | Permit forward rotation | No operation | Prevent reverse rotation | Permit forward rotation |
| Shift position | Low speed forward position | High speed forward position | Neutral position | Low speed reverse position | High speed reverse position |

FIG. 7

BOAT PROPULSION UNIT

BACKGROUND OF THE INVENTION

1. Field of the Invention

The present invention relates to a boat propulsion unit.

2. Description of the Related Art

JP-B-3499204 discloses a Dynamic Positioning System (DPS) as a positioning control system for a boat. Specifically, the DPS is a system in which an actuator is operated based on a deviation between a position signal from the GPS (Global Positioning System) and a position instruction value.

There is a case in which it is desired to make the propulsive speed of a hull substantially zero other than the case that it is desired to retain the hull in a fixed point. Normally, the hull is accelerated, decelerated, or stopped by shift operations of the boat. Therefore, there is a problem that a complicated operation is required to retain the propulsive speed of the hull substantially at zero. There is also a problem that advanced skills are required for this operation.

SUMMARY OF THE INVENTION

In order to overcome the problems described above, preferred embodiments of the present invention provide a boat propulsion unit that can easily retain a moving speed of a hull (hereinafter referred to as the propulsive speed) substantially at zero.

The boat propulsion unit in accordance with a preferred embodiment of the present invention includes a power source, a propeller, a shift position changing mechanism, a control device, and a deceleration switch. The propeller is driven by the power source. The propeller generates a propulsive force. The shift position changing mechanism has an input shaft, an output shaft, and a clutch. The input shaft is connected to a power source side. The output shaft is connected to a propeller side. The clutch changes a connection state between the input shaft and the output shaft. In the shift position changing mechanism, the clutch is engaged or disengaged, and thereby the shift position is changed among forward, neutral, and reverse. The control device adjusts a connecting force of the clutch. The deceleration switch is connected to the control device. The control device controls the connecting force of the clutch so that the propeller generates a propulsive force in the direction opposite to the present moving direction of a hull (hereinafter referred to as the propulsive direction) when the deceleration switch is turned on by the operator of a boat.

The preferred embodiments of the present invention allow the realization of a boat propulsion unit that can easily retain the propulsive speed of a hull substantially at zero.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 7 is a table indicating engagement states of first through third hydraulic clutches and shift positions of the shift mechanism.

DETAILED DESCRIPTION OF THE PREFERRED EMBODIMENTS

Preferred embodiments of the present invention will be described hereinafter with respect to a boat 1 shown in FIG. 1 as an example. However, the following preferred embodiments are only examples of the present invention. The present invention is not limited to the preferred embodiments described below.

In addition, a boat in accordance with the present invention may differ from the preferred embodiments described below and include a boat propulsion system other than an outboard motor. The boat propulsion system may be, for example, a so-called inboard motor or a so-called sterndrive. The sterndrive is also referred to as an "inboard/outboard motor". The "sterndrive" is a boat propulsion system in which at least a power source is placed on a hull. The "sterndrive" includes a system whose components other than the propulsion section are placed on the hull.

Figure 1:
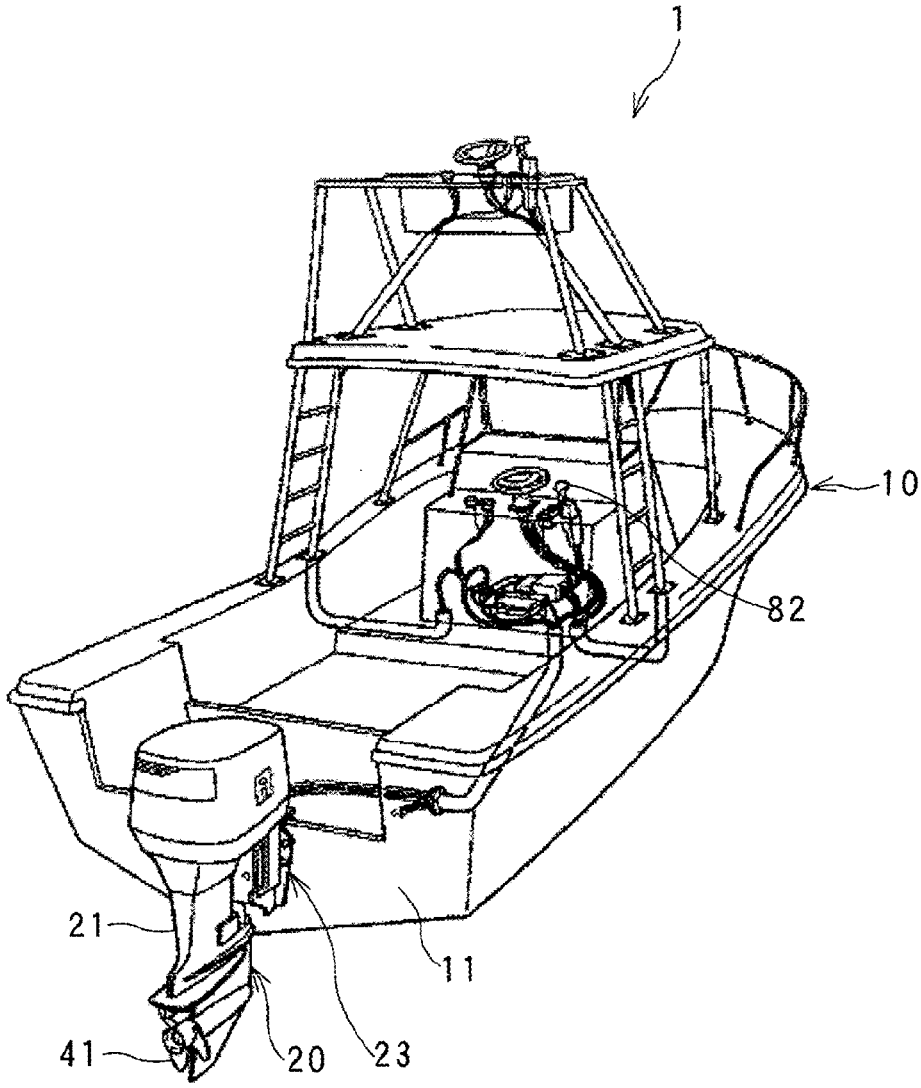
FIG. 1 is a boat in accordance with a preferred embodiment of the present invention as seen obliquely from the rear of the boat.
Figure 2:
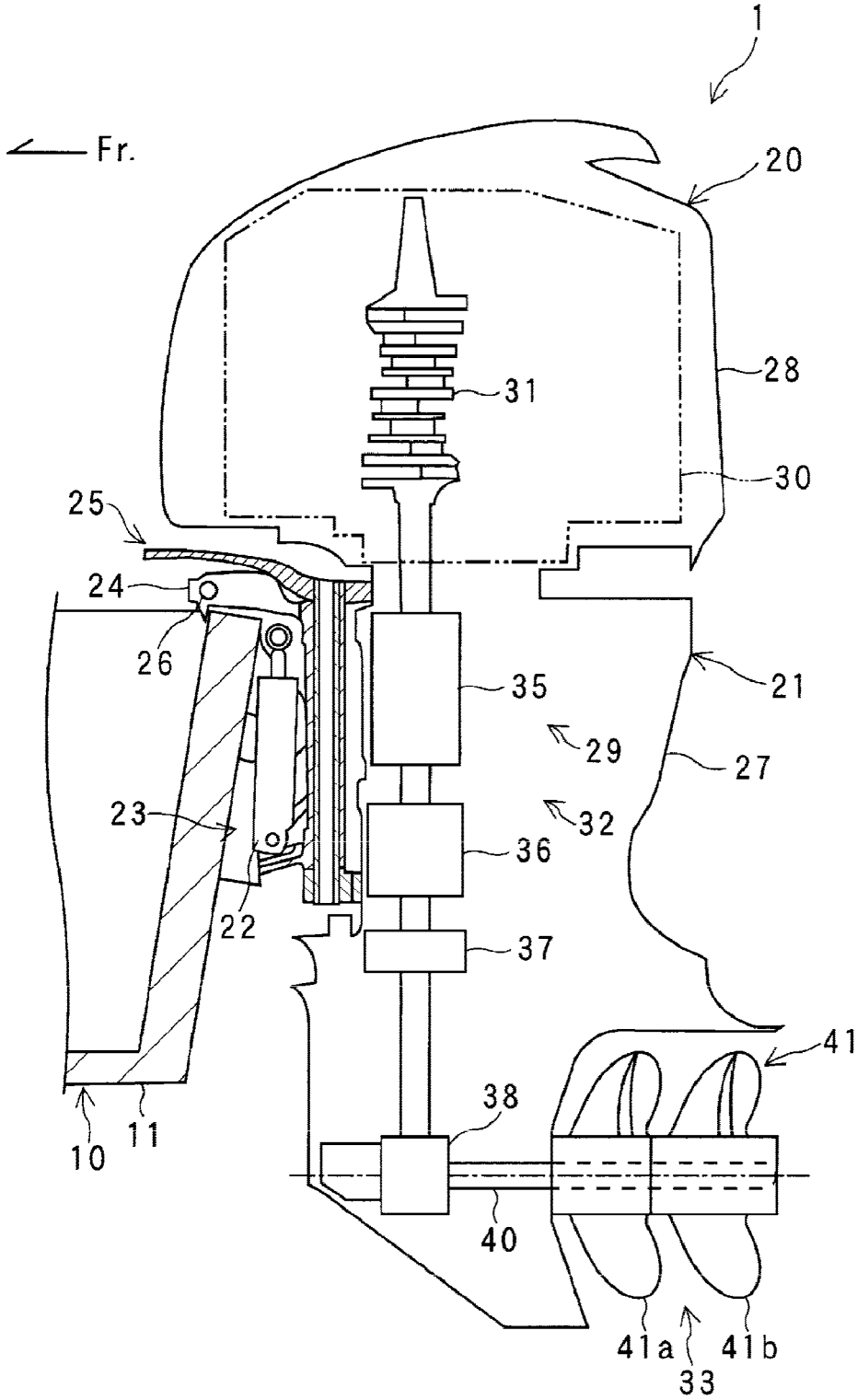
FIG. 2 is a partial cross-sectional view of a stern portion of the boat in accordance with a preferred embodiment of the present invention as seen from a side of the boat.

As shown in FIGS. 1 and 2, the boat 1 includes a hull 10 and an outboard motor 20. The outboard motor 20 is mounted on a stern 11 of the hull 10.

General Construction of Outboard Motor 20

The outboard motor 20 includes an outboard motor main body 21, a tilt-trim mechanism 22, and a bracket 23.

The bracket 23 includes a mount bracket 24 and a swivel bracket 25. The mount bracket 24 is fixed to the hull 10. The swivel bracket 25 is swingable around a pivot shaft 26 with respect to the mount bracket 24.

The tilt-trim mechanism 22 is used to tilt and trim the outboard motor main body 21. Specifically, the tilt-trim mechanism 22 swings the swivel bracket 25 with respect to the mount bracket 24.

The outboard motor main body 21 includes a casing 27, a cowling 28, and a propulsive force generating device 29. The propulsive force generating device 29 is disposed inside the casing 27 and the cowling 28 except for a portion of a propulsion section described below.

Figure 3:
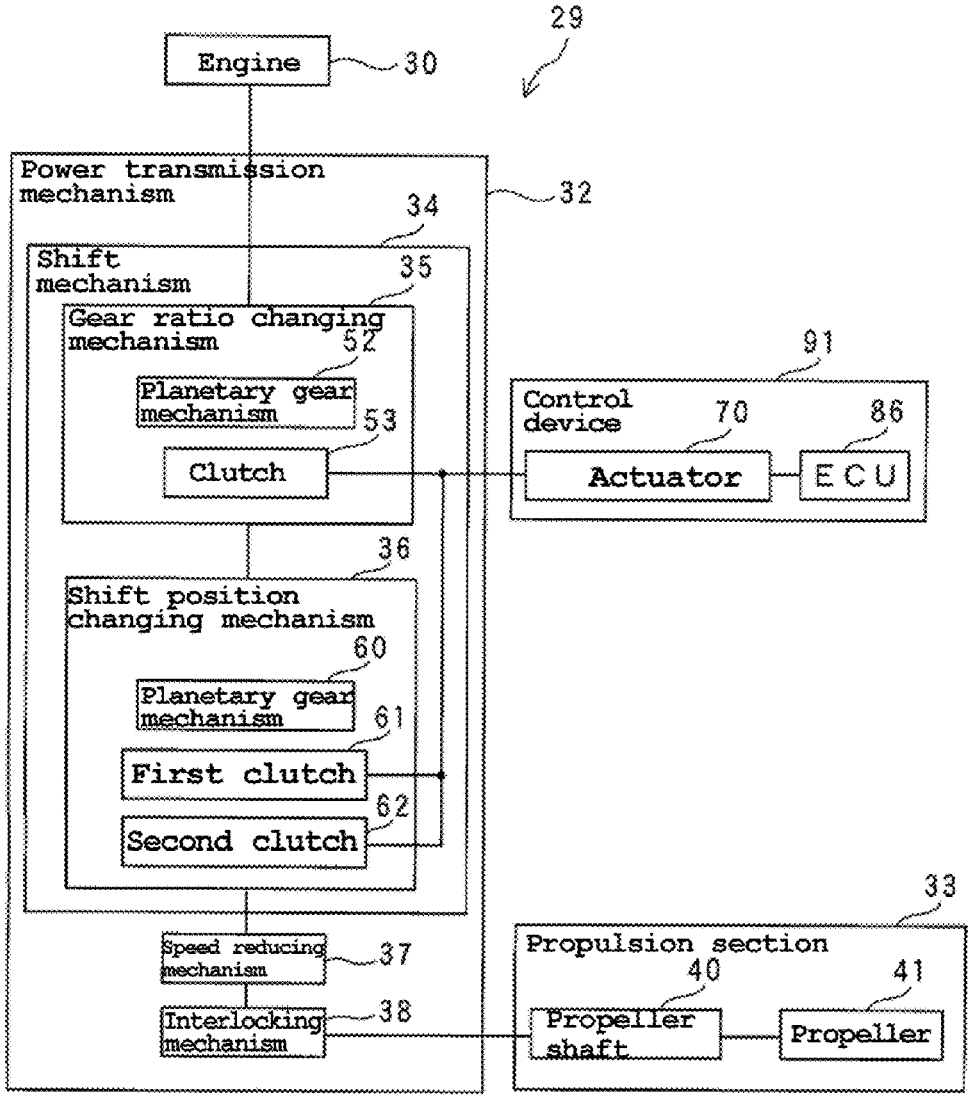
FIG. 3 is a schematic block diagram illustrating a construction of a propulsive force generating device according to a preferred embodiment of the present invention.

As shown in FIGS. 2 and 3, the propulsive force generating device 29 includes an engine 30, a power transmission mechanism 32, and the propulsion section 33.

In the present preferred embodiment, description will be made about an example in which the outboard motor 20 has the engine as a power source. However, the power source is not limited to a particular system as long as it can generate a rotational force. For example, the power source may be an electric motor.

Figure 6:
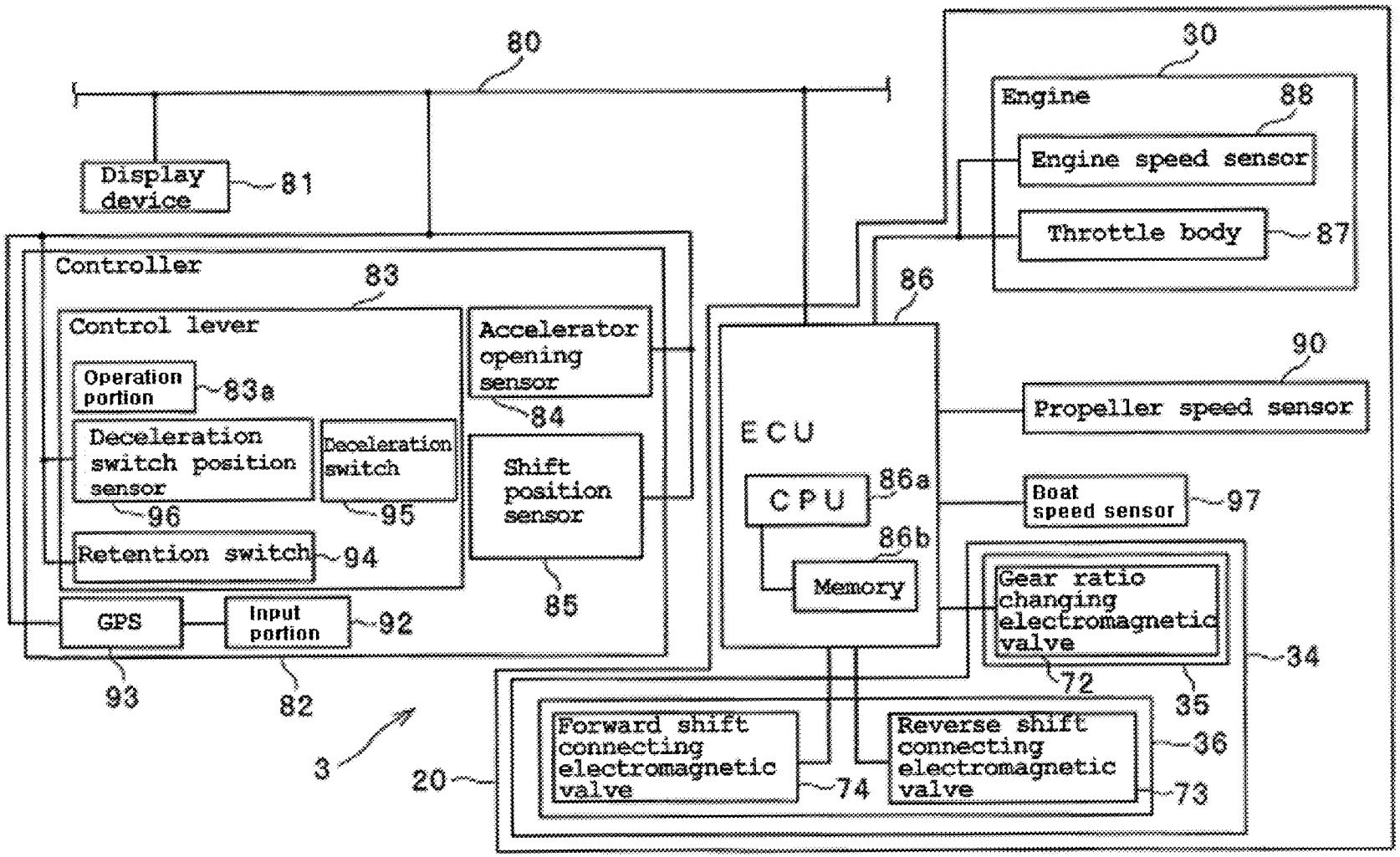
FIG. 6 is a control block diagram of the boat according to a preferred embodiment of the present invention.

The engine 30 is preferably a fuel injection type engine having a throttle body 87 shown in FIG. 6. In the engine 30, the throttle opening is adjusted, thereby adjusting the engine speed and the engine output. The engine 30 generates a rotational force. As shown in FIG. 2, the engine 30 includes a crankshaft 31. The engine outputs the generated rotational force via the crankshaft 31.

The power transmission mechanism 32 is disposed between the engine 30 and the propulsion section 33. The power transmission mechanism 32 transmits the rotational force generated in the engine to the propulsion section 33. As shown in FIG. 3, the power transmission mechanism 32 includes a shift mechanism 34, a speed reducing mechanism 37, and an interlocking mechanism 38.

As shown in FIG. 2, the shift mechanism 34 is connected to the crankshaft 31 of the engine 30. As also shown in FIG. 3, the shift mechanism 34 includes a gear ratio changing mechanism 35 and a shift position changing mechanism 36.

The gear ratio changing mechanism 35 shifts the gear ratio between the engine 30 and the propulsion section 33 between a high-speed gear ratio (HIGH) and a low-speed gear ratio (LOW). Here, the "high-speed gear ratio" is a ratio of the output rotational speed to the input rotational speed which is relatively small. On the other hand, the "low-speed gear ratio" is a ratio of the output rotational speed to the input rotational speed which is relatively large.

The shift position changing mechanism 36 shifts the shift positions among forward, reverse, neutral.

The speed reducing mechanism 37 is disposed between the shift mechanism 34 and the propulsion section 33. The speed reducing mechanism 37 transmits the rotational force from the shift mechanism 34 to a propulsion section 33 at a reduced speed. The speed reducing mechanism 37 is not limited to a specific construction. For example, the speed reducing mechanism 37 may have a planetary gear mechanism. Also, for example, the speed reducing mechanism 37 may have a pair of speed reduction gears.

The interlocking mechanism 38 is disposed between the speed reducing mechanism 37 and the propulsion section 33. The interlocking mechanism 38 includes a set of bevel gears (not shown). The interlocking mechanism 38 changes the direction of the rotational force from the speed reducing mechanism 37 and transmits it to the propulsion section 33.

The propulsion section 33 includes a propeller shaft 40 and a propeller 41. The propeller shaft 40 transmits the rotational force from the interlocking mechanism 38 to the propeller 41. The propulsion section 33 converts the rotational force generated in the engine 30 into the propulsive force.

As shown in FIG. 2, the propeller 41 includes a first propeller 41*a* and a second propeller 41*b*. The helical directions of the first propeller 41*a* and the second propeller 41*b* are opposite to each other. When the rotational force output from the power transmission mechanism 32 is in the normal rotational direction, the first propeller 41*a* and the second propeller 41*b* rotate in directions opposite to each other, and generate a propulsive force in the forward direction. Therefore, the shift position is forward. On the other hand, when the rotational force output from the power transmission mechanism 32 is in the reverse rotational direction, each of the first propeller 41*a* and the second propeller 41*b* rotates in the opposite direction from that for the forward travel. As a result, propulsive force in the reverse direction is generated. Therefore, the shift position is reverse.

The propeller 41 may be constructed with a single, three, or more propellers.

Detailed Construction of Shift Mechanism 34

Figure 4:
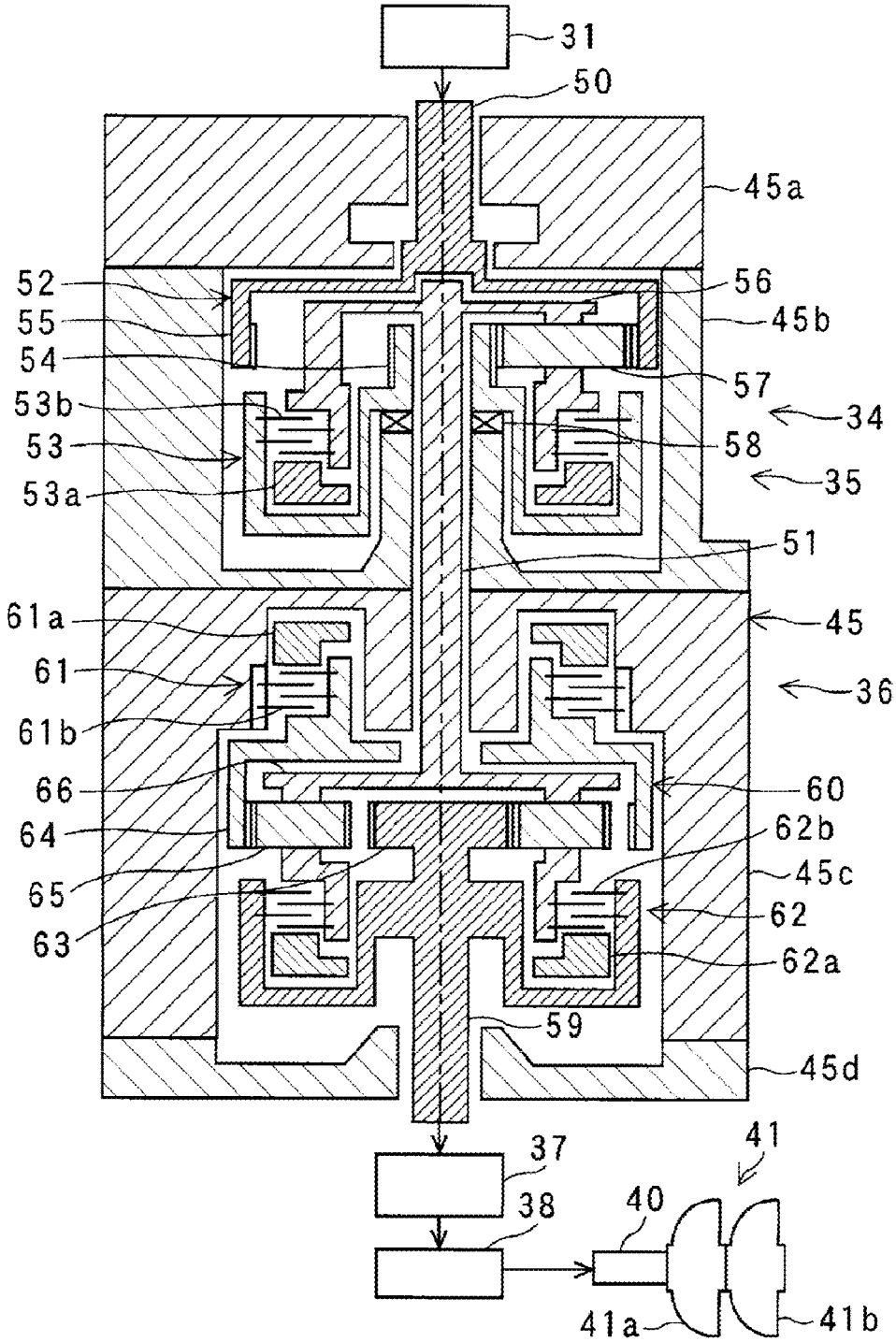
FIG. 4 is a schematic cross-sectional view of a shift mechanism according to a preferred embodiment of the present invention.

Next, a construction of the shift mechanism 34 of the present preferred embodiment will be described in detail mainly with reference to FIG. 4. FIG. 4 schematically illustrates the shift mechanism 34. Therefore, the construction of the shift mechanism 34 illustrated in FIG. 4 does not strictly correspond with an actual construction of the shift mechanism 34.

The shift mechanism 34 includes a shift casing 45. The shift casing 45 has a generally cylindrical external shape. The shift casing 45 includes a first casing 45*a*, a second casing 45*b*, a third casing 45*c*, and a fourth casing 45*d*. The first casing 45*a*, the second casing 45*b*, the third casing 45*c*, and the fourth casing 45*d* are unitarily fixed by bolts or the like.

Gear Ratio Changing Mechanism 35

The gear ratio changing mechanism 35 includes a first power transmission shaft 50 as an input shaft, a second power transmission shaft 51 as an output shaft, a planetary gear mechanism 52 as a series of speed changing gears, and gear ratio changing hydraulic clutch 53.

The planetary gear mechanism 52 transmits rotation of the first power transmission shaft 50 to the second power transmission shaft 51 at the low-speed gear ratio (LOW) or the high-speed gear ratio (HIGH). The gear ratio changing hydraulic clutch 53 is selectively engaged or disengaged to change the gear ratio of the planetary gear mechanism 52.

The first power transmission shaft 50 and the second power transmission shaft 51 are coaxially disposed. The first power transmission shaft 50 is rotatably supported by the first casing 45*a*. The second power transmission shaft 51 is rotatably supported by the second casing 45*b* and the third casing 45*c*. The first power transmission shaft 50 is connected to the crankshaft 31 and the planetary gear mechanism 52.

The planetary gear mechanism 52 includes a sun gear 54, a ring gear 55, a carrier 56, and a plurality of planetary gears 57. The ring gear 55 has a generally cylindrical shape. Teeth to be meshed with the planetary gears 57 are formed on an inner peripheral surface of the ring gear 55. The ring gear 55 is connected to the first power transmission shaft 50. The ring gear 55 rotates together with the first power transmission shaft 50.

The sun gear 54 is disposed inside the ring gear 55. The sun gear 54 and the ring gear 55 rotate coaxially. The sun gear 54 is mounted on the second casing 45*b* via a one-way clutch 58. The one-way clutch 58 permits the normal rotation. However, it restrains the reverse rotation. Therefore, the sun gear 54 is rotatable in the normal rotational direction, but not capable of reverse rotation.

The plurality of planetary gears 57 are disposed between the sun gear 54 and the ring gear 55. Each of the planetary gears 57 is meshed with both of the sun gear 54 and the ring gear 55. Each of the planetary gears 57 is rotatably supported by the carrier 56. Therefore, the plurality of planetary gears 57 revolve around the axis of the first power transmission shaft 50 at the same speed while rotating on their axes.

In this specification, "rotation" means a state that a member turns around an axis positioned in the member. Meanwhile, "revolution" means a state that a member travels around an axis positioned outside the member.

The carrier 56 is connected to the second power transmission shaft 51. The carrier 56 rotates together with the second power transmission shaft 51.

The gear ratio changing hydraulic clutch 53 is disposed between the carrier 56 and the sun gear 54. In this preferred embodiment, the gear ratio changing hydraulic clutch 53 preferably is a wet multi-plate clutch. However, in the present invention, the gear ratio changing hydraulic clutch 53 is not limited to a wet multi-plate clutch. The gear ratio changing hydraulic clutch 53 may be a dry multi-plate clutch or may be a so-called dog clutch.

In this specification, a "multi-plate clutch" includes first and second members rotatable with respect to each other, a single or a plurality of first plates that rotate together with the first member, and a single or a plurality of second plates that rotate together with the second member. In the clutch, the first plates and the second plates are pressed against each other, thereby restraining the rotation of the first member and the second member. In this specification, a "clutch" is not limited to a mechanism that is disposed between an input shaft to which a rotational force is input and an output shaft from which rotational force is output and that connects or disconnects the input shaft and the output shaft.

The gear ratio changing hydraulic clutch 53 includes a hydraulic cylinder 53*a* and a plate series 53*b* including at least one clutch plate and at least one friction plate. When the hydraulic cylinder 53*a* is operated, the plate series 53*b* is brought into a pressure-contact state. Therefore, the gear ratio changing hydraulic clutch 53 is brought into the engaged state. On the other hand, when the hydraulic cylinder 53*a* is not operated, the plate series 53*b* is in a non-contact state. Accordingly, the gear ratio changing hydraulic clutch 53 is brought into the disengaged state.

When the gear ratio changing hydraulic clutch 53 is in the engaged state, the sun gear 54 and the carrier 56 are fixed to each other. Therefore, the sun gear 54 and the carrier 56 unitarily rotate when the planetary gears 57 revolve.

Shift Position Changing Mechanism 36

The shift position changing mechanism 36 shifts among forward, reverse, and neutral. The shift position changing mechanism 36 includes the second power transmission shaft 51 as an input shaft, a third power transmission shaft 59 as an output shaft, a planetary gear mechanism 60 as a rotational direction changing mechanism, a first shift position changing hydraulic clutch 61, and a second shift position changing hydraulic clutch 62.

The first shift position changing hydraulic clutch 61 and the second shift position changing hydraulic clutch 62 connect or disconnect the second power transmission shaft 51 as the input shaft and the third power transmission shaft 59 as the output shaft. Specifically, the first shift position changing hydraulic clutch 61 and the second shift position changing hydraulic clutch 62 are engaged or disengaged to change the connection state between the second power transmission shaft 51 and the third power transmission shaft 59. In other words, the first shift position changing hydraulic clutch 61 and the second shift position changing hydraulic clutch 62 change the connection state between the second power transmission shaft 51 and the third power transmission shaft 59. Specifically, a connecting force between the first shift position changing hydraulic clutch 61 and the second shift position changing hydraulic clutch 62 is adjusted, thereby adjusting the rotational speed of the third power transmission shaft 59 with respect to the rotational speed of the second power transmission shaft 51. More specifically, the connecting force of the first shift position changing hydraulic clutch 61 and the second shift position changing hydraulic clutch 62 is adjusted, thereby adjusting the rotational direction of the third power transmission shaft 59 with respect to the rotational direction of the second power transmission shaft 51 and a ratio of the absolute value of the rotational speed of the third power transmission shaft 59 to the absolute value of the rotational speed of the second power transmission shaft 51.

The planetary gear mechanism 60 changes the rotational direction of the third power transmission shaft 59 with respect to the rotational direction of the second power transmission shaft 51. Specifically, the planetary gear mechanism 60 transmits the rotational force of the second power transmission shaft 51 to the third power transmission shaft 59 as a rotational force in the normal or reverse rotational direction. The first shift position changing hydraulic clutch 61 and the second shift position changing hydraulic clutch 62 are engaged or disengaged, thereby changing the rotational direction of the rotational force transmitted by the planetary gear mechanism 60.

The third power transmission shaft 59 is rotatably supported by the third casing 45*c* and the fourth casing 45*d*. The second power transmission shaft 51 and the third power transmission shaft 59 are coaxially disposed. In this preferred embodiment, the shift position changing hydraulic clutches 61 and 62 preferably are wet type multi-plate clutches. However, each of the shift position changing hydraulic clutches 61 and 62 may be a dog clutch, for example.

The second power transmission shaft 51 is a member shared by the gear ratio changing mechanism 35 and the shift position changing mechanism 36.

The planetary gear mechanism 60 includes a sun gear 63, a ring gear 64, a plurality of planetary gears 65, and a carrier 66.

The carrier 66 is connected to the second power transmission shaft 51. The carrier 66 rotates together with the second power transmission shaft 51. Therefore, accompanying rotation of the second power transmission shaft 51, the carrier 66 rotates, and the plurality of the planetary gears 65 revolve at the same speed.

The plurality of the planetary gears 65 are meshed with the ring gear 64 and the sun gear 63. The first shift position changing hydraulic clutch 61 is disposed between the ring gear 64 and the third casing 45*c*. The first shift position changing hydraulic clutch 61 includes a hydraulic cylinder 61*a* and a plate series 61*b* including at least one clutch plate and at least one friction plate. When the hydraulic cylinder 61*a* is operated, the plate series 61*b* is brought into the pressure-contact state. Therefore, the first shift position changing hydraulic clutch 61 is brought into the engaged state. As a result, the ring gear 64 is fixed to the third casing 45*c* and becomes unrotatable. On the other hand, when the hydraulic cylinder 61*a* is not operated, the plate series 61*b* is in the non-contact state. Therefore, the first shift position changing hydraulic clutch 61 is brought into the disengaged state. As a result, the ring gear 64 is not fixed to the third casing 45*c* and becomes rotatable.

The second shift position changing hydraulic clutch 62 is disposed between the carrier 66 and the sun gear 63. The second shift position changing hydraulic clutch 62 includes a hydraulic cylinder 62*a* and a plate series 62*b* including at least one clutch plate and at least one friction plate. When the hydraulic cylinder 62*a* is operated, the plate series 62*b* is brought into the pressure-contact state. Therefore, the second shift position changing hydraulic clutch 62 is brought into the engaged state. As a result, the carrier 66 and the sun gear 63 unitarily rotate. On the other hand, when the hydraulic cylinder 62*a* is not operated, the plate series 62*b* is in the non-contact state. Therefore, the second shift position changing hydraulic clutch 62 is brought into the disengaged state. As a result, the ring gear 64 and the sun gear 63 can rotate with respect to each other.

The speed reduction ratio of the planetary gear mechanism 60 is not limited to about 1:1. The planetary gear mechanism 60 may have a speed reduction ratio that is different from the value of about 1:1. Further, the speed reduction ratio of the planetary gear mechanism 60 may be the same or different between the cases that the planetary gear 60 transmits the rotational force in the normal rotational direction and that it transmits the rotational force in the reverse rotational direction.

In this preferred embodiment, descriptions will be made about a case that the planetary gear mechanism 60 has a speed reduction ratio that is different from about 1:1 and has the different speed reduction ratios between the cases that the planetary gear mechanism 60 transmits the rotational force in the normal rotational direction and that it transmits the rotational force in the reverse rotational direction.

Specifically, in this preferred embodiment, the ratios between the rotational speed of the first power transmission shaft 50 and the rotational speed of the third power transmission shaft 59 are as follows:

High-speed forward: about 1:1, speed reduction ratio about 1

High-speed reverse: about 1:1.08, speed reduction ratio about 0.93

Low-speed forward: about 1:0.77, speed reduction ratio about 1.3

Low-speed reverse: about 1:0.83, speed reduction ratio about 1.21

As shown in FIG. 3, the shift mechanism 34 is controlled by a control device 91. Specifically, the control device 91 controls engagement and disengagement of the gear ratio changing hydraulic clutch 53, the first shift position changing hydraulic clutch 61, and the second shift position changing hydraulic clutch 62.

The control device 91 includes an actuator 70 and an electronic control unit (ECU) 86 as a control portion. The actuator 70 engages or disengages the gear ratio changing hydraulic clutch 53, the first shift position changing hydraulic clutch 61, and the second shift position changing hydraulic clutch 62. The ECU 86 controls the actuator 70.

Figure 5:
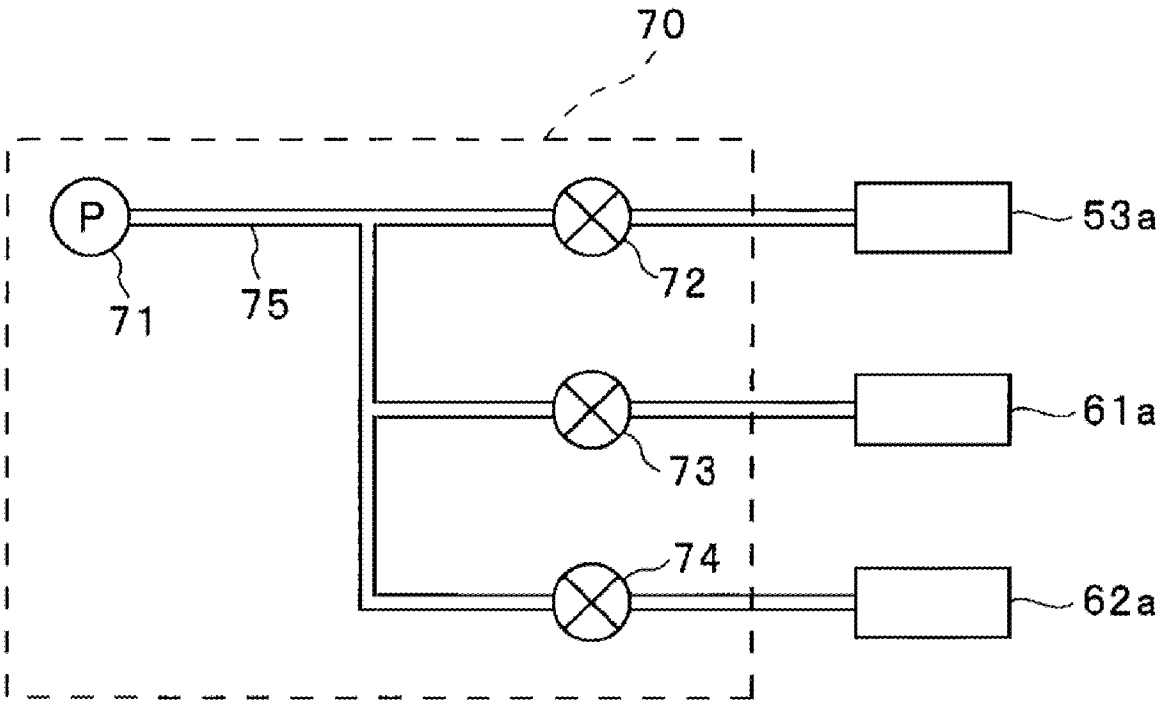
FIG. 5 is an oil circuit diagram according to a preferred embodiment of the present invention.

Specifically, as shown in FIG. 5, the hydraulic cylinders 53*a*, 61*a*, and 62*a* are operated by the actuator 70. The actuator 70 includes an oil pump 71, an oil route 75, a gear ratio changing electromagnetic valve 72, a reverse shift connecting electromagnetic valve 73, and a forward shift connecting electromagnetic valve 74.

The oil pump 71 is connected to the hydraulic cylinders 53*a*, 61*a*, and 62*a* by the oil route 75. The gear ratio changing electromagnetic valve 72 is disposed between the oil pump 71 and the hydraulic cylinder 53*a*. The gear ratio changing electromagnetic valve 72 adjusts the hydraulic pressure of the hydraulic clutch 53*a*. The reverse shift connecting electromagnetic valve 73 is disposed between the oil pump 71 and the hydraulic cylinder 61*a*. The reverse shift connecting electromagnetic valve 73 adjusts the hydraulic pressure of the hydraulic cylinder 61*a*. The forward shift connecting electromagnetic valve 74 is disposed between the oil pump 71 and the hydraulic cylinder 62*a*. The forward shift connecting electromagnetic valve 74 adjusts the hydraulic pressure of the hydraulic cylinder 62*a*.

Each of the gear ratio changing electromagnetic valve 72, the reverse shift connecting electromagnetic valve 73, and the forward shift connecting electromagnetic valve 74 is capable of gradually changing the cross-sectional flow passage area of the oil route 75. Therefore, the pressing force of the hydraulic cylinders 53*a*, 61*a*, and 62*a* can be gradually changed by using the gear ratio changing electromagnetic valve 72, the reverse shift connecting electromagnetic valve 73, and the forward shift connecting electromagnetic valve 74. Accordingly, the connecting force of the hydraulic clutches 53, 61, and 62 can be gradually changed. Therefore, as shown in FIG. 7, the ratio of the rotational force of the third power transmission shaft 59 to that of the second power transmission shaft 51 can be adjusted. As a result, the ratio of the rotational speed between the second power transmission shaft 51 as the input shaft and the third power transmission shaft 59 as the output shaft can be adjusted in a substantially continuous manner.

In this preferred embodiment, each of the gear ratio changing electromagnetic valve 72, the reverse shift connecting electromagnetic valve 73, and the forward shift connecting electromagnetic valve 74 includes a solenoid valve which is controlled by PWM (Pulse Width Modulation) control. However, each of the gear ratio changing electromagnetic valve 72, the reverse shift connecting electromagnetic valve 73, and the forward shift connecting electromagnetic valve 74 may include a valve other than the solenoid valve controlled by PWM control. For example, each of the gear ratio changing electromagnetic valve 72, the reverse shift connecting electromagnetic valve 73, and the forward shift connecting electromagnetic valve 74 may be include a solenoid valve which is controlled in an ON-OFF manner.

Speed Changing Operation of Shift Mechanism 34

Next, a speed changing operation of the shift mechanism 34 will be described in detail mainly with reference to FIGS. 4 and 7. FIG. 7 is a table indicating connection states of the hydraulic clutches 53, 61, and 62 and the shift positions of the shift mechanism 34. The shift position is changed in the shift mechanism 34 by engagement and/or disengagement of the first through third hydraulic clutches 53, 61, and 62.

Shift Between Low-Speed Gear Ratio and High-Speed Gear Ratio

The shift between the low-speed gear ratio and the high-speed gear ratio is performed in the gear ratio changing mechanism 35. Specifically, the gear ratio changing hydraulic clutch 53 is operated to shift between the low-speed gear ratio and the high-speed gear ratio. More specifically, in the case that the gear ratio changing hydraulic clutch 53 is in the disengaged state, the gear ratio of the gear ratio changing mechanism 35 is the "low-speed gear ratio". On the other hand, in the case that the gear ratio changing hydraulic clutch 53 is in the engaged state, the gear ratio of the gear ratio changing mechanism 35 is the "high-speed gear ratio".

As shown in FIG. 4, the ring gear 55 is connected to the first power transmission shaft 50. Therefore, the ring gear 55 rotates in the normal rotational direction when the first power transmission shaft 50 rotates. In the case that the gear ratio changing hydraulic clutch 53 is in the disengaged state, the carrier 56 and the sun gear 54 can rotate with respect to each other. Therefore, the planetary gears 57 rotate and revolve. This urges the sun gear 54 to rotate in the reverse rotational direction.

However, as shown in FIG. 7, the one-way clutch 58 prevents the sun gear 54 from reverse rotation. Therefore, the sun gear 54 is fixed by the one-way clutch 58. As a result, the rotation of the ring gear 55 causes the planetary gears 57 to revolve between the sun gear 54 and the ring gear 55, thereby causing the second power transmission shaft 51 to rotate together with the carrier 56. In this case, because the planetary gears 57 revolve and rotate, the rotation of the first power transmission shaft 50 is transmitted to the second power transmission shaft 51 at a reduced speed. Accordingly, the gear ratio of the gear ratio changing mechanism 35 is the "low-speed gear ratio".

Meanwhile, in the case that the gear ratio changing hydraulic clutch 53 is in the engaged state, the planetary gears 57 and the sun gear 54 unitarily rotate. Therefore, the planetary gears 57 are inhibited from rotating. Accordingly, the rotation of the ring gear 55 causes the planetary gears 57, the carrier 56, and the sun gear 54 to rotate in the normal rotational direction at the same rotational speed as the ring gear 55. As shown in FIG. 7, the one-way clutch 58 permits the sun gear 54 to rotate in the normal rotational direction. As a result, the first power transmission shaft 50 and the second power transmission shaft 51 rotate in the normal rotational direction substantially at the same speed. In other words, the rotational force of the first power transmission shaft 50 is transmitted to the second power transmission shaft 51 at the same rotational speed and in the same rotational direction. Accordingly, the gear ratio of the gear ratio changing mechanism 35 is the "high-speed gear ratio".

Shift Between Forward, Reverse, and Neutral Positions

The shift among forward, reverse, and neutral is performed in the shift position changing mechanism 36. Specifically, the first shift position changing hydraulic clutch 61 and the second shift position changing hydraulic clutch 62 shown in FIG. 4 are operated, to make a shift among the forward, reverse, and neutral.

As shown in FIG. 7, when the first shift position changing hydraulic clutch 61 is in the disengaged state and the second shift position changing hydraulic clutch 62 is in the engaged state, the shift position of the shift position changing mechanism 36 is "forward". When the first shift position changing hydraulic clutch 61 shown in FIG. 4 is in the disengaged state, the ring gear 64 can rotate with respect to the shift casing 45. When the second shift position changing hydraulic clutch 62 is in the engaged state, the carrier 66, the sun gear 63, and the third power transmission shaft 59 unitarily rotate. Therefore, when the first shift position changing hydraulic clutch 61 is in the disengaged state and the second shift position changing hydraulic clutch 62 is in the engaged state, the second power transmission shaft 51, the carrier 66, the sun gear 63, and the third power transmission shaft 59 unitarily rotate in the normal rotational direction. Accordingly, the shift position of the shift position changing mechanism 36 is "forward".

As shown in FIG. 7, when the first shift position changing hydraulic clutch 61 is in the engaged state and the second shift position changing hydraulic clutch 62 is in the disengaged state, the shift position of the shift position changing mechanism 36 is "reverse". When the first shift position changing hydraulic clutch 61 shown in FIG. 4 is in the engaged state and the second shift position changing hydraulic clutch 62 is in the disengaged state, the ring gear 64 is restrained from rotating by the shift casing 45. Meanwhile, the sun gear 63 can rotate with respect to the carrier 66. Accordingly, the planetary gears 65 rotate and revolve accompanying rotation of the second power transmission shaft 51 in the normal rotational direction. As a result, the sun gear 63 and the third power transmission shaft 59 rotate in the reverse rotational direction. Accordingly, the shift position of the shift position changing mechanism 36 is "reverse".

As shown in FIG. 7, when the first shift position changing hydraulic clutch 61 and the second shift position changing hydraulic clutch 62 are both in the disengaged state, the shift position of the shift position changing mechanism 36 is "neutral". When the first shift position changing hydraulic clutch 61 and the second shift position changing hydraulic clutch 62 shown in FIG. 4 are both in the disengaged state, the planetary gear mechanism 60 rotates idly. Therefore, the rotation of the second power transmission shaft 51 is not transmitted to the third power transmission shaft 59. Accordingly, the shift position of the shift position changing mechanism 36 is "neutral".

The shift between the low-speed gear ratio and the high-speed gear ratio and the changes of the shift position are made as described above. Accordingly, as shown in FIG. 7, when the gear ratio changing hydraulic clutch 53 and the first shift position changing hydraulic clutch 61 are in the disengaged state while the second shift position changing hydraulic clutch 62 is in the engaged state, the shift position of the shift mechanism 34 is "low-speed forward".

When the gear ratio changing hydraulic clutch 53 and the second shift position changing hydraulic clutch 62 are in the engaged state and the first shift position changing hydraulic clutch 61 is in the disengaged state, the shift position of the shift mechanism 34 is "high-speed forward".

When the first shift position changing hydraulic clutch 61 and the second shift position changing hydraulic clutch 62 are both in the disengaged state, the shift position of the shift mechanism 34 is "neutral" independently of the engagement state of the gear ratio changing hydraulic clutch 53.

When the gear ratio changing hydraulic clutch 53 and the second shift position changing hydraulic clutch 62 are in the disengaged state and the first shift position changing hydraulic clutch 61 is in the engaged state, the shift position of the shift mechanism 34 is "low-speed reverse".

When the gear ratio changing hydraulic clutch 53 and the first shift position changing hydraulic clutch 61 are in the engaged state and the second shift position changing hydraulic clutch 62 is in the disengaged state, the shift position of the shift mechanism 34 is "high-speed reverse".

Control Block of Boat 1

Next, a control block of the boat 1 will be described mainly with reference to FIG. 6.

A control block of the outboard motor 20 will be first described with reference to FIG. 6. The ECU 86 as the control portion is preferably disposed in the outboard motor 20. The ECU 86 constitutes a portion of the control device 91 shown in FIG. 3. The ECU 86 controls each mechanism of the outboard motor 20.

The ECU 86 includes a CPU (Central Processing Unit) **86*a* as a computing portion and a memory 86*b*. The memory 86*b* stores various settings such as maps described below. The memory 86*b* is connected to the CPU 86*a*. The CPU 86*a* reads out required information from the memory 86*b* when carrying out various computations. In addition, the CPU 86*a* outputs a computation result to the memory 86*b* and makes the memory 86*b*** store the computation result and so forth as needed.

The throttle body 87 of the engine 30 is connected to the ECU 86. The throttle body 87 is controlled by the ECU 86. Therefore, the throttle opening of the engine 30 is controlled. Specifically, the throttle opening of the engine 30 is controlled based on the operation amount of a control lever 83 and a sensitivity changing signal. As a result, the output of the engine 30 is controlled.

An engine speed sensor 88 is connected to the ECU 86. The engine speed sensor 88 detects the rotational speed of the crankshaft 31 of the engine 30 shown in FIG. 2. The engine speed sensor 88 outputs the detected engine speed to the ECU 86.

A boat speed sensor 97 is connected to the ECU 86. The boat speed sensor 97 detects the propulsive speed of the boat 1. The boat speed sensor 97 outputs the detected propulsive speed of the boat 1 to the ECU 86. In this preferred embodiment, the boat speed sensor 97 constitutes a propulsive direction detecting portion that detects the propulsive direction of the boat 1. However, the propulsive direction detecting portion is not limited to the boat speed sensor 97. The propulsive direction detecting portion may be, for example, a GPS 93.

In this preferred embodiment, description will be made about a case that the boat speed sensor 97 is separately provided from the GPS 93. However, the present invention is not limited to this case, and the GPS 93 may include the function of the boat speed sensor.

A propeller speed sensor 90 is disposed closer to the propeller 41 than the second shift position changing hydraulic clutch 62 in the power transmission mechanism 32 shown in FIG. 3. The propeller speed sensor 90 directly or indirectly detects the rotational speed of the propeller 41. The propeller speed sensor 90 outputs the detected rotational speed to the ECU 86. The propeller speed sensor 90 may detect, specifically, the rotational speed of the propeller 41, the propeller shaft 40, or the third power transmission shaft 59.

The gear ratio changing electromagnetic valve 72, the forward shift connecting electromagnetic valve 74, and the reverse shift connecting electromagnetic valve 73 are connected to the ECU 86. The ECU 86 controls open-close operation and adjustment of the opening of the gear ratio changing electromagnetic valve 72, the forward shift connecting electromagnetic valve 74, and the reverse shift connecting electromagnetic valve 73.

As shown in FIG. 6, the boat 1 includes a local area network (LAN) 80. The LAN 80 connects the devices installed in the hull 10. In the boat 1, signals are transmitted and received between the devices via the LAN 80.

The ECU 86 of the outboard motor 20, a controller 82, a display device 81, and so forth are connected to the LAN 80. The controller 82 defines a boat propulsion unit 3 together with the outboard motor 20 as the boat propulsion system. The display device 81 displays information output from the ECU 86 and information output from the controller 82 described below. Specifically, the display device 81 displays the present speed, the shift position, and so forth of the boat 1.

The controller 82 includes the control lever 83, an accelerator opening sensor 84, a shift position sensor 85, the Global Positioning System (GPS) 93 as the detecting portion, and an input portion 92.

The GPS 93 constantly detects the position of the boat 1, thereby detecting the position, movement, and so forth of the boat 1. The "movement of the boat" includes the propulsive speed, moved distance, moving direction, and so forth of the boat. Information detected by the GPS 93 will be referred to as "GPS information" and will be described below. The GPS 93 transmits the obtained GPS information to the ECU 86 and display device 81 via the LAN 80.

The input portion 92 is connected to the GPS 93. Various information is input to the input portion 92 by the operator of the boat.

The control lever 83 includes an operation portion 83*a*, a deceleration switch 95, a deceleration switch position sensor 96, and a retention switch 94.

Figure 8:
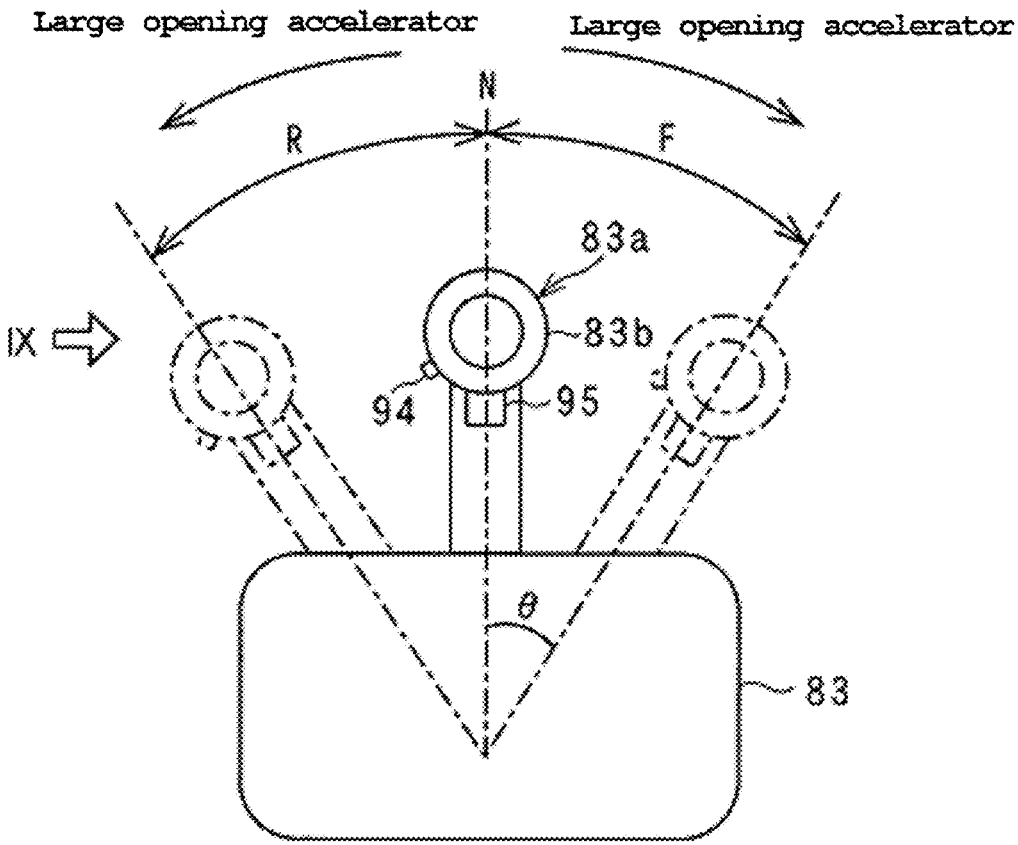
FIG. 8 is a schematic side view of a control lever.

The shift position and the accelerator opening are input to the operation portion 83*a* by operation of the operator of the boat 1. Specifically, as shown in FIG. 8, when the operator of the boat operates the operation portion 83*a*, the accelerator opening and the shift position corresponding to the position of the operation portion 83*a* are respectively detected by the accelerator opening sensor 84 and the shift position sensor 85. The accelerator opening sensor 84 and the shift position sensor 85 are connected to the LAN 80. The accelerator opening sensor 84 and the shift position sensor 85 respectively transmit an accelerator opening signal and a shift position signal to the LAN 80. The ECU 86 receives the accelerator opening signal and the shift position signal output from the accelerator opening sensor 84 and the shift position sensor 85 via the LAN 80.

Specifically, when the operation portion 83*a* of the control lever 83 is positioned in a neutral position indicated by a symbol "N" in FIG. 8, the shift position sensor 85 outputs a shift position signal corresponding to the neutral position. When the operation portion 83*a* of the control lever 83 is positioned in a forward position indicated by a symbol "F" in FIG. 8, the shift position sensor 85 outputs a shift position signal corresponding to the forward position. When the operation portion 83*a* of the control lever 83 is positioned in a reverse position indicated by a symbol "R" in FIG. 8, the shift position sensor 85 outputs a shift position signal corresponding to the reverse position.

The accelerator opening sensor 84 detects the operation amount of the operation portion 83*a*. Specifically, the accelerator opening sensor 84 detects an operation angle θ representing how far the operation portion 83*a* is displaced from a central position. The operation portion 83*a* outputs the operation angle θ as the accelerator opening signal.

Figure 9:
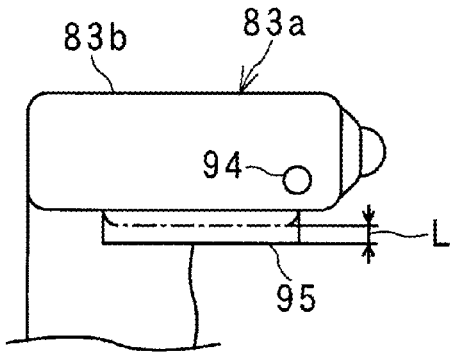
FIG. 9 is a view taken along the arrow IX in FIG. 8.
Figure 10:
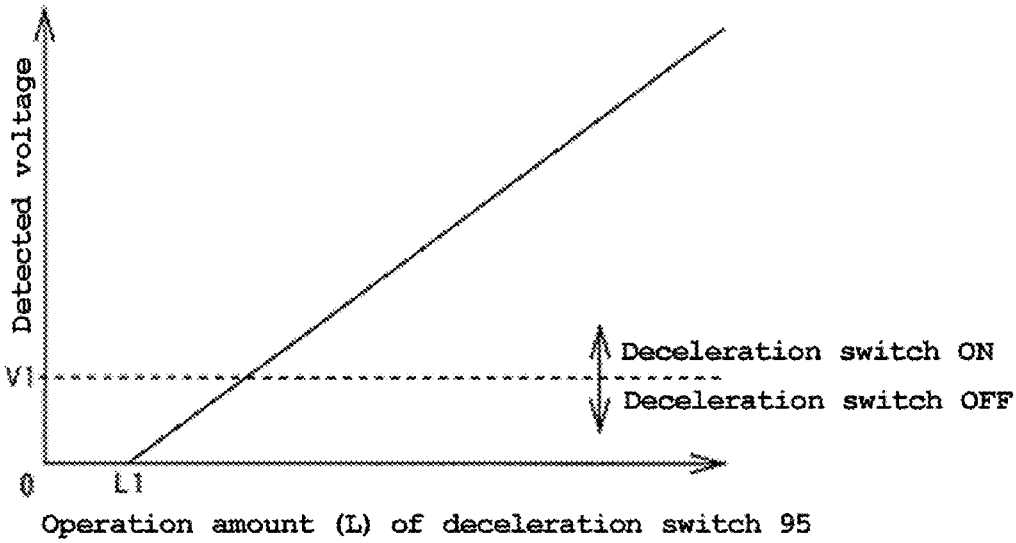
FIG. 10 is a graph indicating the relationship between an operation amount of a deceleration switch and a detected voltage of a deceleration switch position sensor.

As shown in FIGS. 8 and 9, the deceleration switch 95 is disposed in a lower portion of a grip 83*b* extending in the generally horizontal direction of the operation portion 83*a*. The deceleration switch 95 is used to decelerate the boat 1. The deceleration switch position sensor 96 detects an operation amount L of the deceleration switch 95 shown in FIG. 9. The deceleration switch position sensor 96 transmits a deceleration signal at a voltage corresponding to the operation amount L of the deceleration switch 95 to the ECU 86 via the LAN 80. Specifically, as shown in FIG. 10, the deceleration switch position sensor 96 transmits a deceleration signal at a larger voltage to the ECU 86 via the LAN 80 as the operation amount L of the deceleration switch 95 becomes larger. A so-called play range is provided for the deceleration switch 95. Specifically, as shown in FIG. 10, the deceleration switch position sensor 96 does not detect the operation of the deceleration switch 95 or transmit the deceleration signal until the operation amount L of the deceleration switch 95 reaches a predetermined operation amount L1.

The deceleration switch 95 is not limited to a specific shape. The deceleration switch 95 have, for example, a rectangular shape or a circular shape in a plan view.

Figure 11:
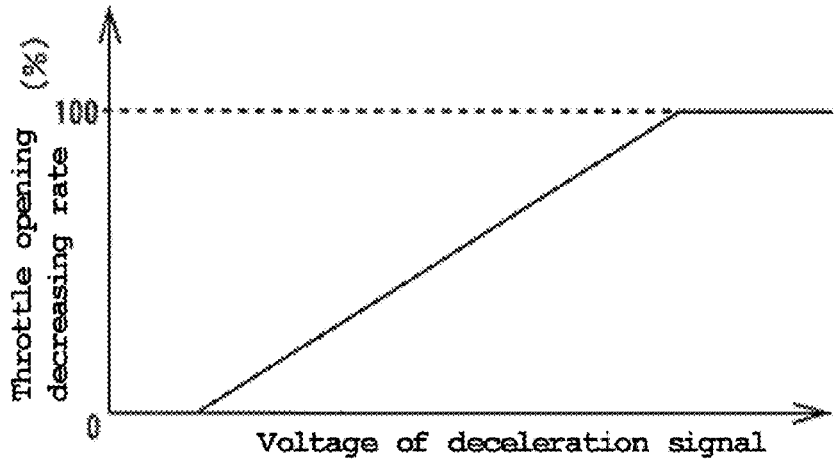
FIG. 11 is a graph indicating a voltage of a deceleration signal and a decreasing rate of the throttle opening.

When the deceleration switch 95 is operated by the operator of the boat, the ECU 86 controls the throttle opening based on the deceleration signal from the deceleration switch position sensor 96. Specifically, the memory 86*b* stores a map that defines the relationship between the voltage of the deceleration signal and the throttle opening decreasing rate as indicated in FIG. 11. The CPU 86*a* reduces the throttle opening based on the map. Specifically, the CPU 86*a* reduces the throttle opening as the operation amount L of the deceleration switch 95 and the voltage of the deceleration signal from the deceleration switch position sensor 96 increase. Thereby, the propulsive force of the boat 1 is reduced. As a result, the propulsive speed of the boat 1 is gradually lowered.

As shown in FIGS. 8 and 9, the retention switch 94 is disposed on a side of the grip 83*b*. The retention switch 94 is used to start boat speed retention control as described below.

When the retention switch 94 is operated by the operator of the boat, a boat speed retention signal is transmitted from the retention switch 94 to the ECU 86 via the LAN 80. The ECU 86 executes the boat speed retention control described below when it receives the boat speed retention signal.

Control of Boat 1

Next, control of the boat 1 will be described.

Basic Control of Boat 1

When the control lever 83 is operated by the operator of the boat 1, the accelerator opening and the shift position corresponding to the operation state on the control lever 83 are detected by the accelerator opening sensor 84 and the shift position sensor 85. The detected accelerator opening and the shift position are transmitted to the LAN 80. The ECU 86 receives the output accelerator opening signal and the shift position signal via the LAN 80. The ECU 86 controls the throttle body 87 and the shift position changing hydraulic clutches 61 and 62 based on the throttle opening calculated from the accelerator opening signal. Thereby, the ECU 86 controls the propeller speed.

The ECU 86 controls the shift mechanism 34 in response to the shift position signal. Specifically, when the ECU 86 receives the shift position signal of the "low-speed forward", the ECU 86 operates the gear ratio changing electromagnetic valve 72 to disengage the gear ratio changing hydraulic clutch 53. Also, the ECU 86 operates the shift connecting electromagnetic valves 73 and 74 to disengage the first shift position changing hydraulic clutch 61, thereby engaging the shift position changing hydraulic clutch 62. Accordingly, the shift position is changed to the "low-speed forward".

Specific Control of Boat 1 (Deceleration Control)

Next, deceleration control executed when the deceleration switch 95 is operated by the operator of the boat in this preferred embodiment will be next described in detail with reference to FIGS. 12 through 16.

Figure 12:
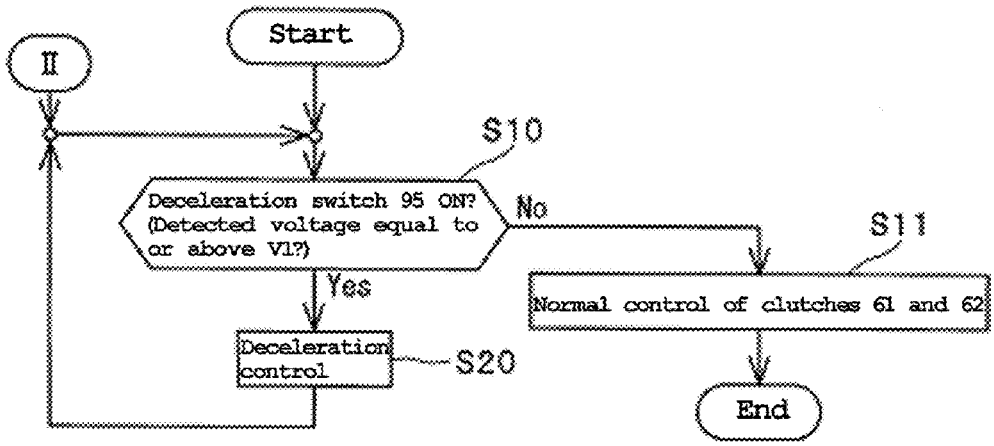
FIG. 12 is a flowchart demonstrating deceleration control according to a preferred embodiment of the present invention.

As shown in FIG. 12, the ECU 86 first determines whether or not the deceleration switch 95 is turned on in step S10. In other words, the ECU 86 determines whether or not the detected voltage of the deceleration switch position sensor 96 is equal to or larger than a voltage of V1 shown in FIG. 10. If it is determined in step S10 that the deceleration switch is turned off, the process proceeds to step S11.

In step S11, the ECU 86 executes normal control of the shift position changing hydraulic clutches 61 and 62 in a state that the deceleration switch 95 is not operated.

If the deceleration switch 95 is turned off when the operation portion 83*a* of the control lever 83 is in the position corresponding to forward or reverse, the shift position is changed to the position corresponding to that of the operation portion 83*a* in a state that the output of the engine 30 is regulated to a predetermined output or below. The "predetermined output" in this case may preferably be set to a value of about 600 rpm to about 1,000 rpm, for example.

On the other hand, if it is determined in step S10 that the deceleration switch 95 is turned on, the process proceeds to step S20. In step S20, the ECU 86 executes the deceleration control. When step S20 is finished, the process again returns to step S10.

Figure 13:
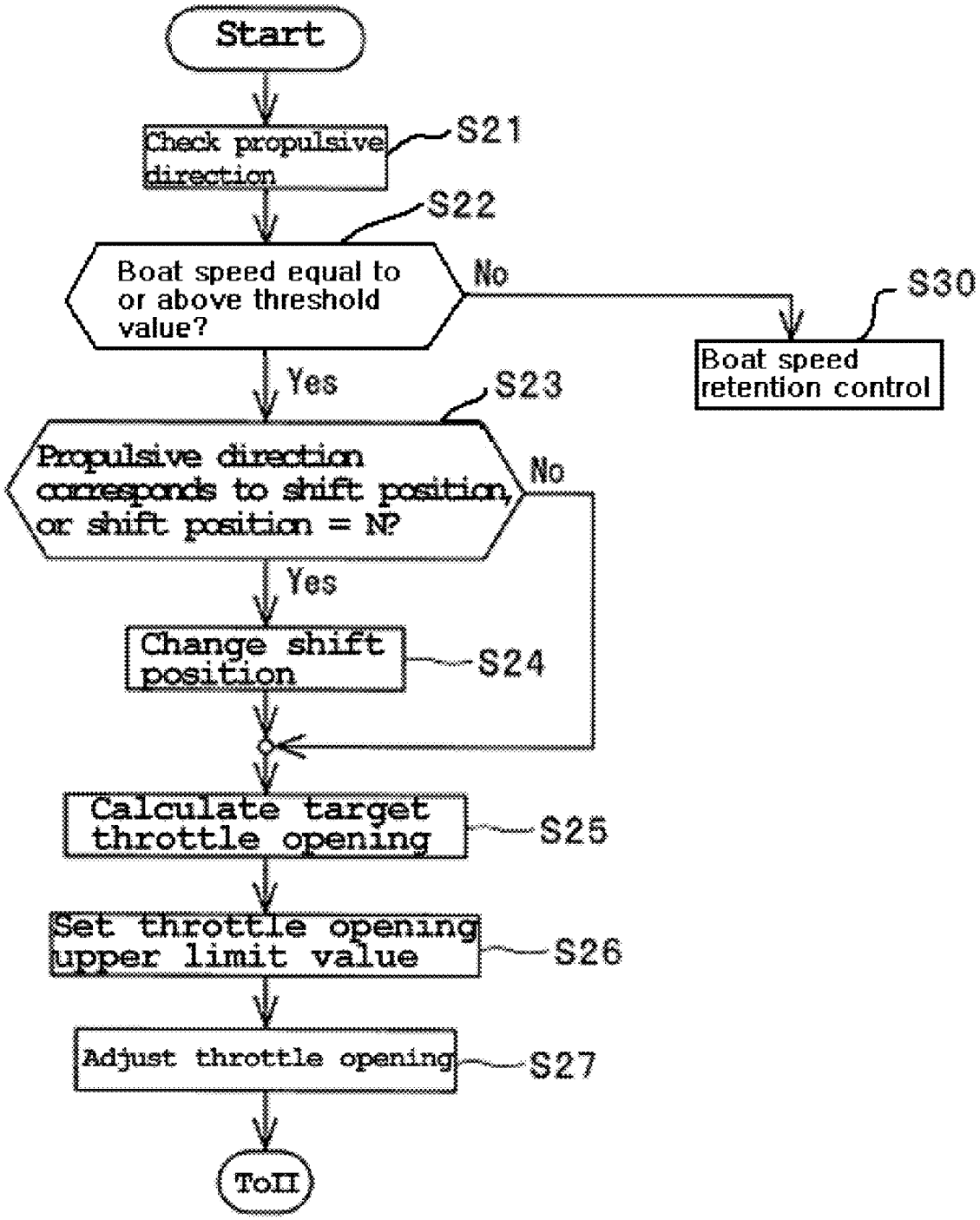
FIG. 13 is a flowchart demonstrating the deceleration control according to a preferred embodiment of the present invention.

The deceleration control executed in step S20 will be next described in detail mainly with reference to FIG. 13.

In the deceleration control in this preferred embodiment, the ECU 86 first checks the propulsive direction of the boat 1 in step S21.

Step S22 is next executed. In step S22, the ECU 86 determines whether or not the boat speed is equal to or higher than a threshold value based on the output of the boat speed sensor 97.

The threshold value in step S22 can be appropriately set in response to characteristics of the boat 1. Normally, the threshold value in step S22 is set to a value such that it is determined that the boat speed is substantially zero if the boat speed is equal to or smaller than the threshold value in step S22. The threshold value in step S22 may be set to a value of approximately 0.5 km/h through 1.5 km/h, for example.

If it is determined in step S22 that the boat speed is equal to or smaller than the threshold value, the process proceeds to step S30. In step S30, the ECU 86 executes the boat speed retention control described below in detail.

Meanwhile, if it is determined in step S22 that the boat speed is equal to or larger than the threshold value, the process proceeds to step S23. In step S23, the ECU 86 determines whether or not the shift position of the shift position changing mechanism 36 corresponds to the propulsive direction of the boat 1 or whether or not the shift position of the shift position changing mechanism 36 is neutral. If it is determined in step S23 that the shift position of the shift position changing mechanism 36 is opposite to the propulsive direction of the boat 1, the process proceeds to step S25 without executing step S24. In other words, if the process proceeds from step S23 to step S25, the propulsive direction of the boat 1 is reverse while the shift position of the shift position changing mechanism 36 is forward, or the propulsive direction of the boat 1 is forward while the shift position of the shift position changing mechanism 36 is reverse.

On the other hand, if it is determined in step S23 that the shift position of the shift position changing mechanism 36 corresponds to the propulsive direction of the boat 1 or that the shift position of the shift position changing mechanism 36 is neutral, the process proceeds to step S24. In other words, if the process proceeds from step S23 to step S24, it is the case that the shift position of the shift position changing mechanism 36 is forward and the propulsive direction of the boat 1 is forward, that the shift position of the shift position changing mechanism 36 is reverse and the propulsive direction is reverse, or that the shift position of the shift position changing mechanism 36 is neutral.

In step S24, the ECU 86 executes a shift change. Specifically, in step S24, the ECU 86 changes the shift position of the shift position changing mechanism 36 so that the shift position of the shift position changing mechanism 36 becomes opposite to the propulsive direction of the boat 1. In other words, in step S24, the shift position of the shift position changing mechanism 36 is changed to reverse when the propulsive direction of the boat 1 is the forward direction. Meanwhile, if the propulsive direction of the boat 1 is forward, the shift position of the shift position changing mechanism 36 is changed to reverse. Step S25 is executed following step S24.

In step S25, the ECU 86 calculates a target throttle opening. Specifically, the CPU 86*a* of the ECU 86 reads out the map stored in the memory 86*b*, which is shown in FIG. 11. The CPU 86*a* applies the voltage of the deceleration signal output from the deceleration switch position sensor 96 to the map shown in FIG. 11, thereby calculating the target throttle opening.

Figure 14:
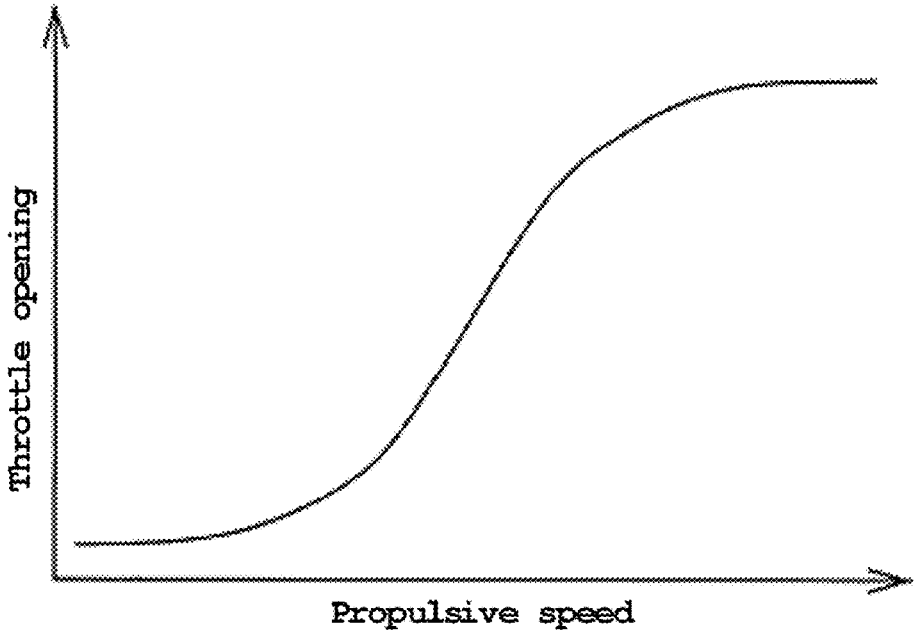
FIG. 14 is a map which defines the relationship between propulsive speed and the throttle opening.

Step S26 is executed next. In step S26, the ECU 86 sets an upper limit value of the throttle opening. Specifically, in step S26, the CPU 86*a* of the ECU 86 reads out a map stored in the memory 86*b*, which is shown in FIG. 14. The map shown in FIG. 14 defines the propulsive speed and the upper limit value of the throttle opening. The CPU 86*a* applies the propulsive speed of the boat 1 output from the boat speed sensor 97 to the map shown in FIG. 14, thereby calculating the throttle opening upper limit value.

Step S27 is executed following step S26. In step S27, the ECU 86 adjusts the throttle opening based on the throttle opening calculated in step S25 and the throttle opening upper limit value calculated in step S26. Specifically, if the target throttle opening calculated in step S25 is below the throttle opening upper limit value calculated in step S26, the CPU 86*a* adjusts the throttle opening to the target throttle opening calculated in step S25. On the other hand, if the target throttle opening calculated in step S25 is above the throttle opening upper limit value calculated in step S26, the CPU 86*a* adjusts the throttle opening to the throttle opening upper limit value calculated in step S26.

When step S27 is finished, the process returns to step S10 as shown in FIG. 12. In other words, continuous control is repeatedly executed during the period that the deceleration switch 95 has been turned on.

Now, specific contents of the boat speed retention control executed in step S30 shown in FIG. 13 will be described in detail with reference to FIGS. 15 and 16.

Figure 15:
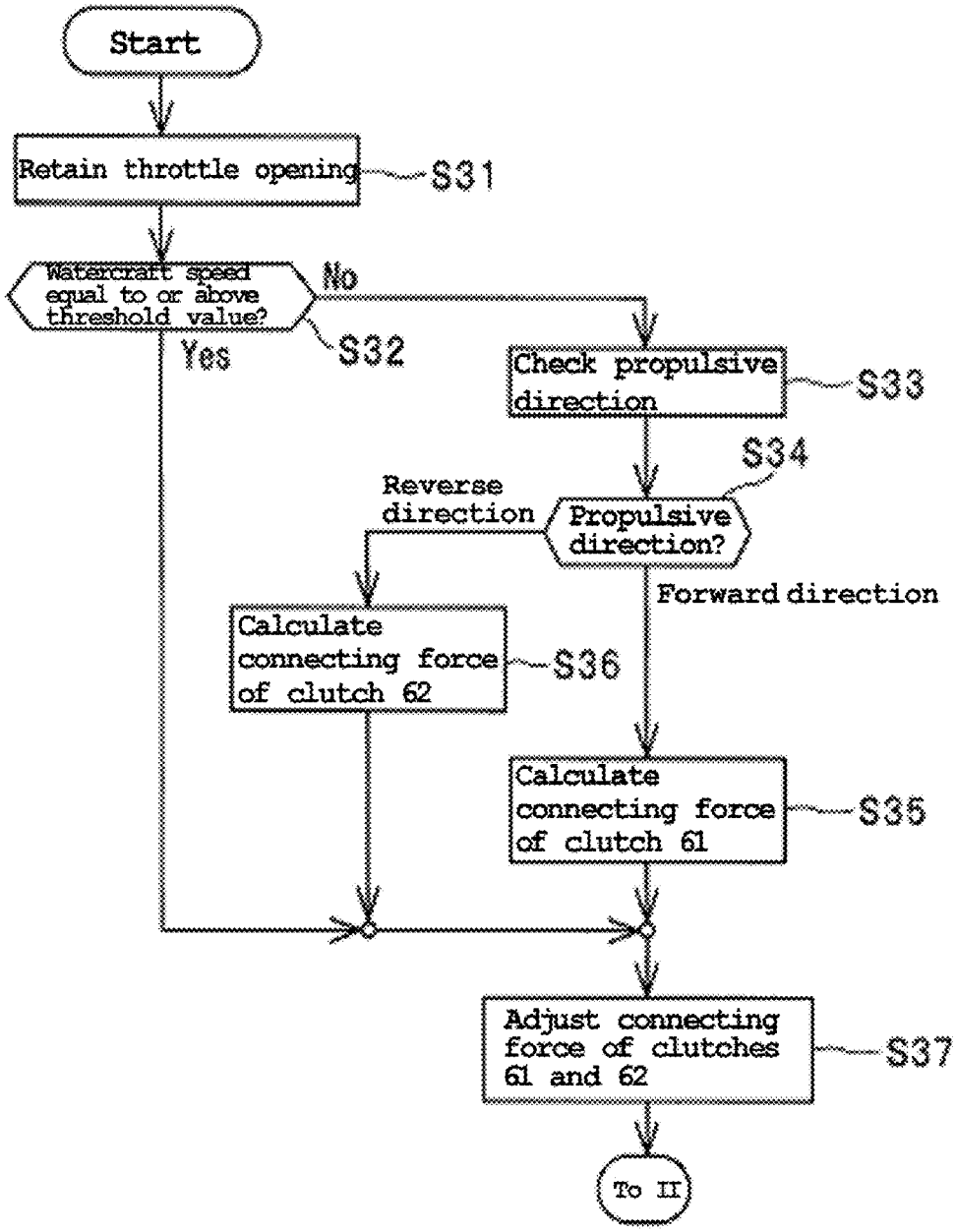
FIG. 15 is a flowchart demonstrating boat speed retention control according to a preferred embodiment of the present invention.

As shown in FIG. 15, in the boat speed retention control, the ECU 86 first retains the present throttle opening in step S31.

Step S32 is executed next. In step S32, the ECU 86 determines whether or not the boat speed is equal to or lower than a threshold value based on a boat speed signal output from the boat speed sensor 97. If it is determined that the boat speed is equal to or lower than the threshold value in step S32, the process proceeds to step S37 without executing steps S33 through S36.

Meanwhile, if it is determined in step S32 that the boat speed is equal to or higher than the threshold value, the process proceeds to step S33.

The threshold value in step S32 can be appropriately set in response to the characteristics of the boat 1. The threshold value in step S32 may be set to a value of approximately 0.5 km/h to 1.5 km/h, for example.

In step S33, the ECU 86 checks the propulsive direction of the boat 1 based on the boat speed output from the boat speed sensor 97.

Step S34 is executed next. In step S34, the ECU 86 determines the propulsive direction of the boat 1. If it is determined that the propulsive direction of the boat 1 is the forward direction in step S34, the process proceeds to step S35. In step S35, the CPU 86*a* calculates the connecting force of the first shift position changing hydraulic clutch 61. Meanwhile, if it is determined that the propulsive direction is the reverse direction in step S34, the process proceeds to step S36. In step S36, the ECU 86 calculates the connecting force of the second shift position changing hydraulic clutch 62.

Specifically, in this preferred embodiment, the connecting forces of the shift position changing hydraulic clutches 61 and 62 in steps S35 and S36 are calculated in the following manner. The CPU 86*a* multiplies (−propeller speed), which is obtained by multiplying the present propeller speed output from the propeller speed sensor 90 by (−1), by a gain. The gain is not limited to a specific kind.

Figure 16:
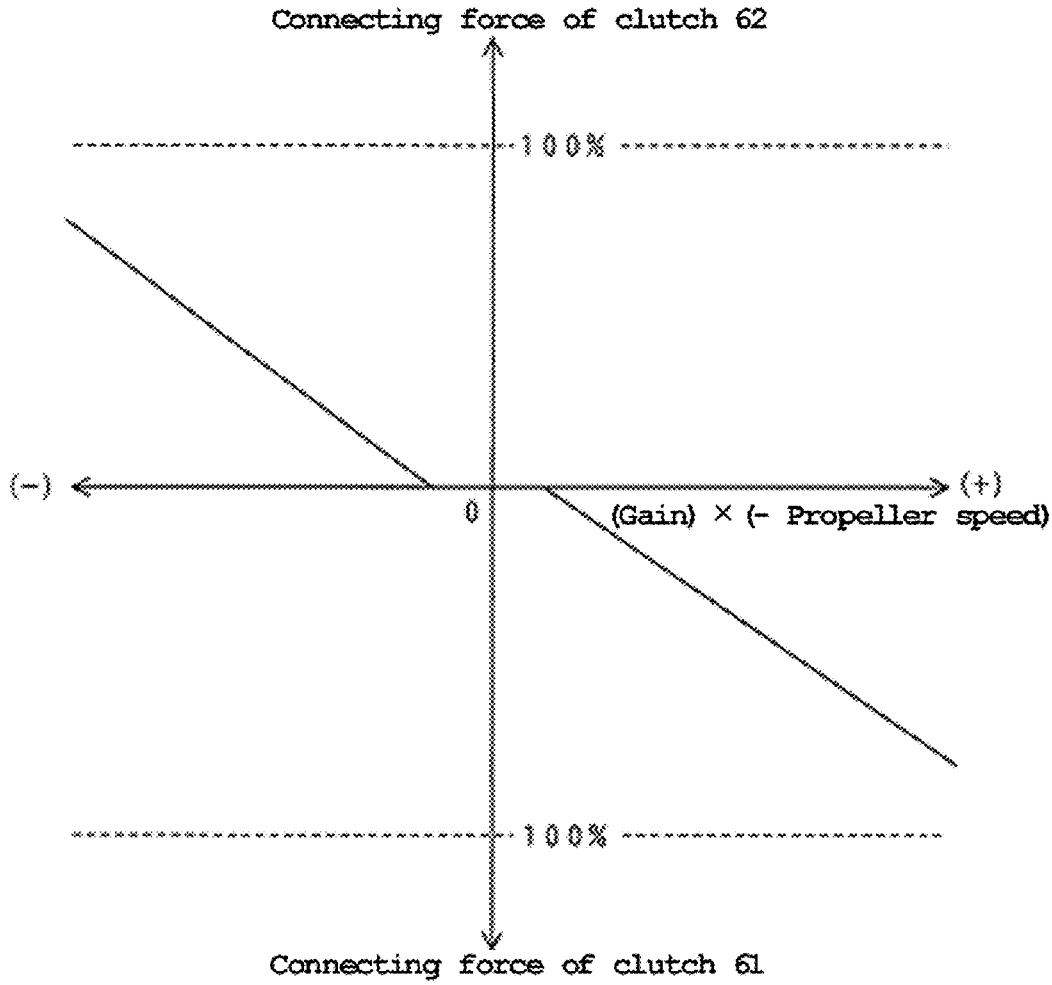
FIG. 16 is a map which defines (gain) multiplied by (−propeller speed) and a connecting force of the shift position changing hydraulic clutches.

The CPU 86*a* applies the calculated (gain) multiplied by (−propeller speed) to a map stored in the memory 86*b* which is shown in FIG. 16, thereby calculating the connecting forces of the shift position changing hydraulic clutches 61 and 62.

Step S37 is executed following steps S35 and S36. In step S37, the ECU 86 adjusts the connecting forces of the shift position changing hydraulic clutches 61 and 62.

In step S37, the connecting forces of the shift position changing hydraulic clutches 61 and 62 are gradually increased to a target connecting force.

In this preferred embodiment, even in a state that the retention switch 94 shown in FIG. 6 is on, the deceleration control and the boat speed retention control are executed similarly to a state that the deceleration switch 95 is operated. Therefore, in the state that the retention switch 94 is on, the connecting forces of the shift position changing hydraulic clutches 61 and 62 are controlled so that the propulsive speed of the boat 1 is retained at the "threshold value" in step S32 shown in FIG. 15 or below. Specifically, in the state that the retention switch 94 is on, the connecting forces of the shift position changing hydraulic clutches 61 and 62 are controlled so that the propulsive speed of the boat 1 is retained substantially at zero.

Figure 17:
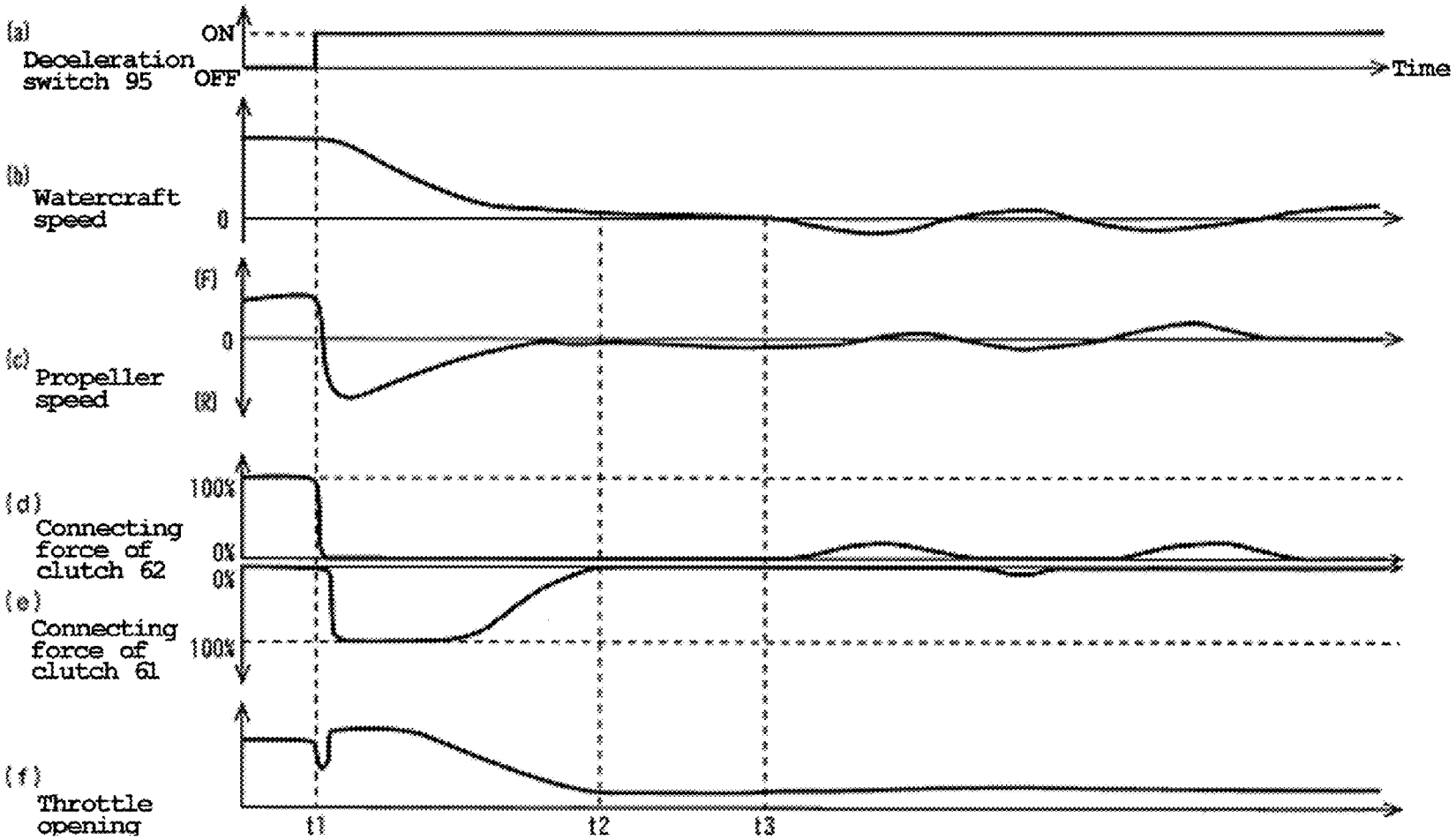
FIG. 17 is a time chart indicating an exemplary case of the deceleration control of the boat according to a preferred embodiment of the present invention.

FIG. 17 is a time chart indicating an exemplary case of the deceleration control of the boat 1 in this preferred embodiment.

In the case indicated in FIG. 17, the deceleration switch 95 is turned on at time t1. Therefore, at the time t1, disengagement of the second shift position changing hydraulic clutch 62 is started, and engagement of the first shift position changing hydraulic clutch 61 is started. Accordingly, the propeller 41 rotates in the reverse direction that is opposite to the forward direction as the propulsive direction of the boat 1. As a result, the boat speed approaches zero from the time t1 to time t2.

The boat speed retention control in step S30 shown in FIG. 13 is executed from the time t2 onward. Therefore, the boat speed is retained substantially at zero from the time t2 onward.

In the case shown in FIG. 17, no boat speed is generated from the time t2 to time t3. The boat speed is generated from the time t3 onward. Therefore, the connecting forces of the first and the second shift position changing hydraulic clutches 61 and 62 are controlled so that the propulsive force in the direction opposite to the propulsive direction is generated in the boat 1.

Movement of the boat from a fixed point can be prevented by using a Dynamic Positioning System disclosed in JP-B-3499204, for example. However, the Dynamic Positioning System disclosed in JP-B-3499204 is not necessarily able to retain the boat speed substantially at zero. For example, in the case of having high waves and/or a fast ocean current, the boat speed may increase due to operation of the Dynamic Positioning System. Accordingly, the Dynamic Positioning System cannot necessarily satisfy the need to retain the boat speed substantially at zero.

In contrast, in this preferred embodiment, operation of the deceleration switch 95 or the retention switch 94 shown in FIG. 6 facilitates retention of the boat speed substantially at zero.

Also, in this preferred embodiment, turning on of the retention switch 94 or continuous operation of the deceleration switch 95 allows retention of the boat speed substantially at zero.

It is considered that, for example, the operator of the boat constantly repeats operation of the operation portion 83*a* of the control lever 83 as another method for retaining the boat speed substantially at zero. However, the operator of the boat needs to have an advanced skill to retain the boat speed substantially at zero with this method.

In this preferred embodiment, the boat speed can easily be retained substantially at zero only by the operation of the deceleration switch 95 and/or the retention switch 94.

Particularly, when the retention switch 94 is used, the boat speed retention control can be continued even when the operator of the boat is away from the controller 82.

In this preferred embodiment, the connecting force of the shift position changing hydraulic clutch 61 or 62 is gradually increased to the target connecting force when the shift position changing hydraulic clutch 61 or 62 is engaged. Therefore, shift operation can be made more smoothly.

In this preferred embodiment, the upper limit value of the throttle opening is set based on the map shown in FIG. 14 in step S26 shown in FIG. 13. Therefore, the throttle opening is controlled by a relatively small degree in the case that the propulsive speed is low during the deceleration control. Accordingly, a relatively small propulsive force is generated in the boat 1 when the propulsive speed is relatively low. Therefore, the boat speed can more precisely approach zero. On the other hand, the throttle opening is controlled by a relatively large degree in the case that the propulsive speed is high. Accordingly, a relatively large propulsive force is generated in the boat 1 when the propulsive speed is relatively high. Therefore, the boat speed can be quickly reduced in the case that the boat speed is high.

In this preferred embodiment, the decreasing rate of the throttle opening is calculated based on the map shown in FIG. 11 in step S25 shown in FIG. 13. Specifically, in the case that the operator of the boat operates the operation portion 83*a* by a small degree and the voltage of the deceleration signal is small, a result of the calculation is a small throttle opening decreasing rate. This results in minor deceleration. On the other hand, in the case that the operator of the boat operates the operation portion 83*a* by a large degree and the voltage of the deceleration signal is large, a result of the calculation is a large throttle opening decreasing rate. This results in major deceleration. As described above, the degree of boat deceleration is adjusted in response to the operation degree of the operation portion 83*a* by the operator of the boat. Accordingly, this preferred embodiment allows the deceleration control that more certainly reflects the intention of the operator of the boat.

It is preferable that the first and second shift position changing hydraulic clutches 61 and 62 be multi-plate clutches as in the present preferred embodiment. This is because such a construction facilitates the minute adjustment of the connecting forces of the shift position changing hydraulic type clutches 61 and 62.

It is preferable that the first and second shift position changing hydraulic clutches 61 and 62 be controlled by hydraulic pressure as in the present preferred embodiment. This is because such a construction further facilitates the minute adjustment of the connecting forces of the shift position changing hydraulic type clutches 61 and 62.

In the present preferred embodiment, as described above, if the deceleration switch 95 is turned off when the operation portion 83*a* of the control lever 83 is in the position corresponding to forward or reverse, the shift position is changed to the position corresponding to that of the operation portion 83*a* in the state that the output of the engine 30 is regulated to the predetermined output or below. Therefore, switching from the deceleration control to the normal control is more smoothly made.

First Modification

In the above preferred embodiment, the description is made about a boat 1 preferably having the single outboard motor 20 as an example of the boat propulsion system. However, in the present invention, the boat may have a plurality of boat propulsion systems. For example, as shown in FIG. 18, a right outboard motor 20*a* and a left outboard motor 20*b* may be disposed in a boat 2.

Figure 18:
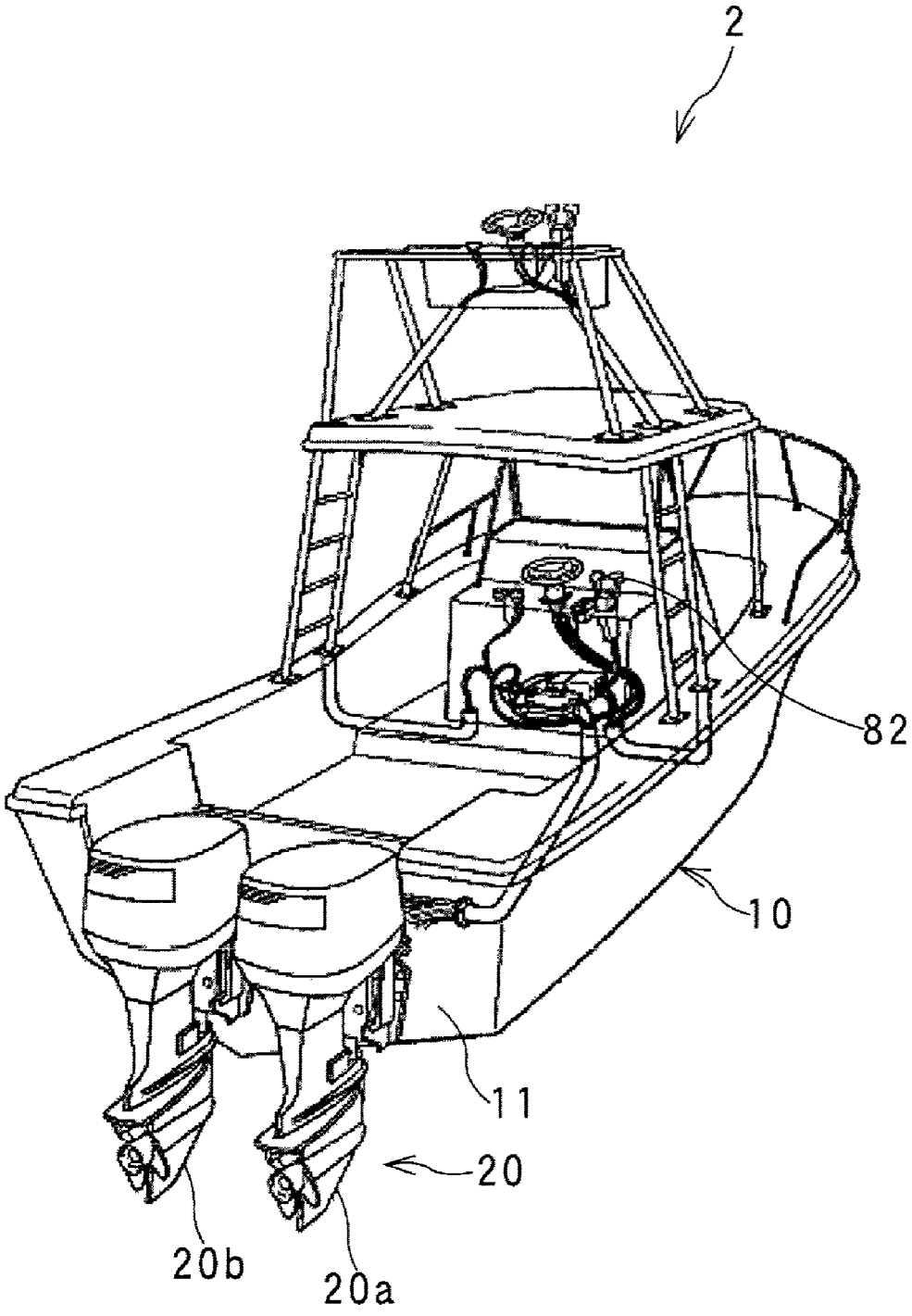
FIG. 18 is a boat in accordance with a second preferred embodiment as seen obliquely from the rear of the boat.

In the case that the plurality of boat propulsion systems are disposed in the boat as shown in FIG. 18, it is preferable that the first and second shift position changing hydraulic clutches 61 and 62 be controlled in a synchronized manner in the plurality of boat propulsion systems.

Second Modification

In the above preferred embodiment, as shown in FIG. 12, the description is made about a case that switching to the normal control of the shift position changing hydraulic clutches 61 and 62 is consistently made independently of the state of the operation portion 83*a* of the control lever 83 when the deceleration switch 95 is turned off. However, the present invention is not limited to this case.

For example, the boat speed retention control may be stopped only when the operation portion 83*a* is in the position corresponding to neutral. Specifically, in the case that the deceleration switch 95 is turned off when the operation portion 83*a* is in the position corresponding to neutral during the boat speed retention control in step S30, the boat speed retention control is stopped. On the other hand, the boat speed retention control may be continued in the case that the deceleration switch 95 is turned off when the operation portion 83*a* is in the position corresponding to forward or reverse.

For example, if the boat speed retention control is stopped in the case that the deceleration switch 95 is turned off when the operation portion 83*a* is in the position corresponding to forward or reverse, the shift position changing hydraulic clutch 61 or 62 may be suddenly engaged. However, as described above, the boat speed retention control is stopped only when the operation portion 83*a* is in the position corresponding to neutral. Therefore, the sudden engagement of the shift position changing hydraulic clutch 61 or 62 can be prevented.

Similarly, during the boat speed retention control in step S30, the boat speed retention control may be stopped if the retention switch 94 is turned off when the operation portion 83*a* is in the position corresponding to neutral, and the boat speed retention control may be continued if the retention switch 94 is turned off when the operation portion 83*a* is in the position corresponding to forward or reverse.

Third Modification

For the reason similar to the second modification, the deceleration control in step S20 may be stopped only when the operation portion 83*a* is in the position corresponding to neutral. Specifically, the deceleration control in step S20 may be stopped if the deceleration switch 95 is turned off when the operation portion 83*a* is in the position corresponding to neutral. Meanwhile, the deceleration control in step S20 may be continued if the deceleration switch 95 is turned off when the operation portion 83*a* is in the position corresponding to forward or reverse.

For example, the deceleration control in step S20 may be continued if the deceleration switch 95 is turned off when the operation portion 83*a* is in the position corresponding to forward or reverse, and the deceleration control in step S20 may be stopped when the operator of the boat subsequently operates the operation portion 83*a* to the position corresponding to neutral.

Fourth Modification

For example, if the operator of the boat turns off the deceleration switch 95 or the retention switch 94 when the operation portion 83*a* of the control lever 83 is in the position corresponding to forward or reverse, the shift position of the shift position changing mechanism 36 may be temporarily changed to neutral, and the output of the engine 30 may be regulated to a predetermined output or below. This prevents a shift to the forward or reverse position in a state that the output of the engine 30 is large.

In this case, the shift position of the shift position changing mechanism 36 is changed to neutral. Meanwhile, the operation portion 83*a* of the control lever 83 is retained at the position corresponding to forward or reverse. In this case, the shift position of the shift position changing mechanism 36 does not correspond to the position of the operation portion 83*a*. However, after the operation portion 83*a* is returned to the position corresponding to neutral, the shift position of the shift position changing mechanism 36 again corresponds to the position of the operation portion 83*a*.

Other Modifications

For example, the deceleration control in step S20 and the boat speed retention control in step S30 may be executed only when the operation portion 83*a* of the control lever 83 is in the position corresponding to neutral. In other words, the deceleration control in step S20 and the boat speed retention control in step S30 may be prevented from being executed when the operation portion 83*a* of the control lever 83 is in the position corresponding to forward or reverse.

This can retain the boat speed at a low speed even when the deceleration switch 95 and/or the retention switch 94 are turned off.

For example, in the case that the retention switch 94 is turned on when the boat speed is not substantially zero, the signal from the retention switch 94 may be made invalid. In other words, the boat speed retention control in step S30 may not be executed even when the retention switch 94 is turned on. Also, when the boat speed is not substantially zero, the retention switch 94 may be made inoperable.

The deceleration switch 95 may include the function of the retention switch 94. In other words, as in the above preferred embodiment, the boat speed retention control in step S30 may be executed by keeping the deceleration switch 95 on. In such a case, the retention switch 94 is not necessarily provided separately from the deceleration switch 95.

In the above preferred embodiments, descriptions are made about a case that the shift position changing mechanism 36 preferably includes the single planetary gear mechanism 60, the two shift position changing hydraulic clutches 61 and 62. However, in the present invention, the shift position changing mechanism is not limited to this construction. For example, the shift position changing mechanism may be constructed with a forward-reverse switching mechanism disposed in the interlocking mechanism and a clutch that connects or disconnects the transmission between the forward-reverse switching mechanism and the engine 30.

In the above preferred embodiments, the memory 86*b* in the ECU 86 installed in the outboard motor 20 preferably stores the map for the control of the gear ratio changing mechanism 35 and the map for the control of the shift position changing mechanism 36. Also, the CPU 86*a* in the ECU 86 installed in the outboard motor 20 preferably outputs control signals for controlling the electromagnetic valves 72, 73, and 74.

However, the present invention is not limited to this construction. For example, the controller 82 installed on the hull 10 may have a memory as a storage portion and a CPU as a computing portion together with the memory 86*b* and the CPU 86*a* or instead of the memory 86*b* and the CPU 86*a*. In this case, a memory provided in the controller 82 may store the map for the control of the gear ratio changing mechanism 35 and the map for the control of the shift position changing mechanism 36. In addition, a CPU provided in the controller 82 may output the control signals for controlling the electromagnetic valves 72, 73, and 74.

In the above preferred embodiments, descriptions are made about a case that the ECU 86 preferably executes control of both the engine 30 and the electromagnetic valves 72, 73, and 74. However, the present invention is not limited to this case. For example, an ECU for controlling the engine and an ECU for controlling the electromagnetic valves may be separately provided.

In the above preferred embodiments, descriptions are made about a case that the controller 82 is a so-called "electronic controller". Herein, the "electronic controller" is a controller that converts the operation amount of the control lever 83 into an electric signal and outputs the electric signal to the LAN 80.

However, in the present invention, the controller 82 may not be the electronic controller. The controller 82 may be a so-called mechanical controller, for example. Herein, the "mechanical controller" is a controller that includes a control lever and a wire connected to the control lever and transmits the operation amount and the operational direction of the control lever to the outboard motor as physical amounts that are the operation amount and the operational direction of the wire.

In the above preferred embodiments, descriptions are made about a case that the shift mechanism 34 has the gear ratio changing mechanism 35. However, the shift mechanism 34 may not have the gear ratio changing mechanism 35. For example, the shift mechanism 34 may include only the shift position changing mechanism 36.

In this specification, the connecting force of the clutch is a value representing the engagement state of the clutch. In other words, for example, "the connecting force of the gear ratio changing hydraulic clutch 53 is 100%" means a state that the hydraulic cylinder 53*a* is operated to bring the plate series 53*b* into the complete pressure-contact and the gear ratio changing hydraulic clutch 53 is completely engaged. On the other hand, for example, "the connecting force of the gear ratio changing hydraulic clutch 53 is 0%" means a state that the hydraulic cylinder 53*a* is not operated, thus the plate series 53*b* are separated from each other and in the non-contact state, and the gear ratio changing hydraulic clutch 53 is completely disengaged. In addition, for example, "the connecting force of the gear ratio changing hydraulic clutch 53 is 80%" means a so-called half-clutch state. In this state, the gear ratio changing hydraulic type clutch 53 is operated to bring the plate series 53*b* into contact by pressure, and drive torque transmitted from the first power transmission shaft 50 as the input shaft to the second power transmission shaft as the output shaft or the rotational speed of the second power transmission shaft 51 is 80% compared to the state that the gear ratio changing hydraulic clutch 53 is completely engaged.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A boat propulsion unit comprising:

a power source;

a propeller driven by the power source to generate a propulsive force;

a shift position changing mechanism including an input shaft connected to a power source side, an output shaft connected to a propeller side, and a clutch to change a connection state between the input shaft and the output shaft, and to change a shift position among forward, neutral, and reverse positions by engaging and disengaging the clutch;

a control device to adjust a connecting force of the clutch; and a deceleration switch connected to the control device; wherein the control device controls the connecting force of the clutch so that the propeller generates a propulsive force in a direction opposite to a present moving direction of a hull when the deceleration switch is turned on by an operator of a boat.

2. The boat propulsion unit according to claim 1, further comprising a moving direction detecting portion to detect a moving direction of the hull.

3. The boat propulsion unit according to claim 1, wherein the clutch includes:

a first clutch to come into an engaged state when the shift position of the shift position changing mechanism is the reverse position and to come into a disengaged state when the shift position of the shift position changing mechanism is the forward or neutral position; and a second clutch to come into the engaged state when the shift position of the shift position changing mechanism is the forward position and to come into the disengaged state when the shift position of the shift position changing mechanism is the reverse or neutral position; wherein the control device disengages the second clutch and increases a connecting force of the first clutch in the case that the moving direction of the hull is a forward direction when the deceleration switch is turned on by the operator of the boat, whereas the control device disengages the first clutch and increases a connecting force of the second clutch in the case that the moving direction of the hull is a reverse direction when the deceleration switch is turned on by the operator of the boat.

4. The boat propulsion unit according to claim 3, wherein the control device gradually increases the connecting force of the first clutch or the connecting force of the second clutch when the deceleration switch is turned on by the operator of the boat.

5. The boat propulsion unit according to claim 1, further comprising a moving speed detecting portion to detect a moving speed of the hull, wherein the control device regulates an output of the power source in response to the moving speed of the hull when the deceleration switch has been turned on by the operator of the boat.

6. The boat propulsion unit according to claim 1, wherein the control device controls an output of the power source in response to an operation amount of the deceleration switch when the deceleration switch is turned on by the operator of the boat.

7. The boat propulsion unit according to claim 1, further comprising a moving speed detecting portion to detect a moving speed of the hull, wherein the control device controls the connecting force of the clutch and thereby retains the moving speed of the hull in a longitudinal direction of the hull substantially at zero in the case that the moving speed of the hull is substantially zero when the deceleration switch has been turned on by the operator of the boat.

8. The boat propulsion unit according to claim 7, further comprising:

a control lever to select the shift position by operation of the operator of the boat; and a shift position detecting portion to output a shift position signal corresponding to a position of the control lever to the control device; wherein the control device stops retention control in the case that the deceleration switch is turned off by the operator of the boat when the control lever is in a position corresponding to the neutral position of the shift position changing mechanism and the retention control is being made to retain the moving speed of the hull in the longitudinal direction of the hull substantially at zero, whereas the control device does not stop the retention control in the case that the deceleration switch is turned off by the operator of the boat when the control lever is in a position corresponding to the forward or reverse position of the shift position changing mechanism and the retention control is being made.

9. The boat propulsion unit according to claim 1, further comprising:

a control lever to select the shift position by operation of the operator of the boat; and a shift position detecting portion to output a shift position signal corresponding to a position of the control lever to the control device; wherein the control device continues control of the connecting force of the clutch to retain the moving speed of the hull in the longitudinal direction of the hull substantially at zero in the case that the deceleration switch is turned off and the control lever is in a position corresponding to the forward or reverse position of the shift position changing mechanism.

10. The boat propulsion unit according to claim 9, wherein the control device continues the control of the connecting force of the clutch to retain the moving speed of the hull in the longitudinal direction of the hull substantially at zero in the case that the deceleration switch is turned off and the control lever is in the position corresponding to the forward or reverse position of the shift position changing mechanism, and stops the control of the connecting force of the clutch to retain the moving speed of the hull in the longitudinal direction of the hull substantially at zero when the operator of the boat subsequently operates the control lever to a position corresponding to the neutral position of the shift position changing mechanism.

11. The boat propulsion unit according to claim 1, further comprising a retention switch connected to the control device, wherein the control device controls the connecting force of the clutch and thereby retains the moving speed of the hull in a longitudinal direction of the hull substantially at zero when the retention switch has been turned on by the operator of the boat.

12. The boat propulsion unit according to claim 11, further comprising:

a control lever to select the shift position by operation of the operator of the boat; and a shift position detecting portion to output a shift position signal corresponding to a position of the control lever to the control device; wherein the control device stops retention control to retain the moving speed of the hull in the longitudinal direction of the hull substantially at zero in the case that the retention switch is turned off by the operator of the boat when the control lever is in a position corresponding to the neutral position of the shift position changing mechanism, whereas the control device does not stop the retention control in the case that the retention switch is turned off by the operator of the boat when the control lever is in a position corresponding to the forward or reverse position of the shift position changing mechanism.

13. The boat propulsion unit according to claim 1, further comprising:

a control lever to select the shift position by operation of the operator of the boat; and a shift position detecting portion to output a shift position signal corresponding to a position of the control lever to the control device; wherein the clutch includes:

a first clutch to come into an engaged state when the shift position of the shift position changing mechanism is the reverse position and to come into a disengaged state when the shift position of the shift position changing mechanism is the forward or neutral position; and a second clutch to come into the engaged state when the shift position of the shift position changing mechanism is the forward position and to come into the disengaged state when the shift position of the shift position changing mechanism is the reverse or neutral position; wherein in the case that the deceleration switch is turned on by the operator of the boat and subsequently turned off by the operator of the boat when the control lever is in a position corresponding to the forward or reverse position of the shift position changing mechanism, the control device controls a connecting force of one of the first and second clutches so that the propeller generates the propulsive force in a direction opposite to the moving direction of the hull when the deceleration switch is turned on by the operator of the boat, and the control device disengages one of the first and second clutches and gradually increases the connecting force of the other of the first and second clutches while regulating an output of the power source to a predetermined output or below when the deceleration switch is turned off.

14. The boat propulsion unit according to claim 1, further comprising:

a control lever to select the shift position by operation of the operator of the boat; and a shift position detecting portion to output a shift position signal corresponding to a position of the control lever to the control device; wherein the control device brings the shift position changing mechanism into the neutral position and regulates an output of the power source to a predetermined output or below in the case that the deceleration switch is turned off by the operator of the boat when the control lever is in a position corresponding to the forward or reverse position of the shift position changing mechanism.

15. The boat propulsion unit according to claim 1, further comprising a plurality of boat propulsion systems each including the power source, the propeller, and the shift position changing mechanism, wherein the control device controls connecting forces of the clutches in each of the plurality of the boat propulsion systems in a synchronized manner.

16. The boat propulsion unit according to claim 1, wherein the clutch is a multi-plate clutch.

17. The boat propulsion unit according to claim 1, wherein the control device includes:

an actuator to operate the clutch; and a control portion to control the actuator; wherein the actuator includes:

an oil pump to generate hydraulic pressure and engage the clutch by the hydraulic pressure;

an oil route to connect the oil pump and the clutch; and a valve disposed in the oil route to gradually change a cross-sectional flow passage area of the oil route.

* * * * *